US008925434B2

(12) United States Patent
Omura et al.

(10) Patent No.: US 8,925,434 B2
(45) Date of Patent: Jan. 6, 2015

(54) TABLET SPLITTING APPARATUS

(75) Inventors: Yoshihito Omura, Tokyo (JP); Syunji Ohgaya, Tokyo (JP)

(73) Assignee: Tosho, Inc., Tokyo (JP)

( * ) Notice: Subject to any disclaimer, the term of this patent is extended or adjusted under 35 U.S.C. 154(b) by 224 days.

(21) Appl. No.: 13/812,674

(22) PCT Filed: Apr. 13, 2011

(86) PCT No.: PCT/JP2011/059214

§ 371 (c)(1),
(2), (4) Date: Jan. 28, 2013

(87) PCT Pub. No.: WO2012/014533

PCT Pub. Date: Feb. 2, 2012

(65) Prior Publication Data

US 2013/0125722 A1 May 23, 2013

(30) Foreign Application Priority Data

Jul. 29, 2010 (JP) ..... 2010-170968
Feb. 28, 2011 (JP) ..... 2011-042955

(51) Int. Cl.
*B26D 7/06* (2006.01)

(52) U.S. Cl.
USPC ..... 83/106; 83/104; 83/367; 225/93

(58) Field of Classification Search
USPC ..... 83/104, 106, 361, 367, 209, 401, 411.1; 225/93, 96.5
See application file for complete search history.

(56) References Cited

U.S. PATENT DOCUMENTS 3,363,741 A * 1/1968 Dierksheide ..... 198/480.1
4,131,041 A * 12/1978 Ludemann et al. ..... 83/94
4,199,863 A * 4/1980 Deckert ..... 30/124
4,473,192 A * 9/1984 Urban et al. ..... 241/168
4,887,755 A * 12/1989 Gibilisco ..... 225/103
4,903,877 A * 2/1990 Hnatuk ..... 225/93

(Continued)

FOREIGN PATENT DOCUMENTS

JP 11-226088 8/1999
JP 11-226089 8/1999
JP 2001-061945 3/2001

OTHER PUBLICATIONS

International Search Report, Application No. PCT/JP2011/059214, 2 pages.

(Continued)

*Primary Examiner* — Sean Michalski
(74) *Attorney, Agent, or Firm* — Rankin, Hill & Clark LLP

(57) ABSTRACT

A tablet splitting apparatus capable of reducing fluctuations in weight of split tablet pieces even with simple advanceable-retractable blades is provided. A holding mechanism holds a tablet to be split at a cutting position. In reducing the gap between a pair of opposed blades, which are advanced and retracted with respect to the cutting position, to cut the tablet, the holding mechanism continuously holds the tablet until the tablet is caught between the pair of opposed blades of a cutting mechanism. After the tablet is caught between the pair of opposed blades, the holding mechanism release the tablet and only the pair of opposed blades hold the tablet. The opposed blades are caused to cut into the tablet after the holding mechanism releases the tablet, preventing a crack caused in the tablet ahead of the opposed blades from being curved or increased.

19 Claims, 38 Drawing Sheets

(56) References Cited

U.S. PATENT DOCUMENTS

| | | | | |
|---|---|---|---|---|
| 4,964,555 | A * | 10/1990 | Hnatuk | 225/93 |
| 5,038,475 | A * | 8/1991 | Wolff | 30/124 |
| 5,118,021 | A * | 6/1992 | Fiocchi | 225/103 |
| 5,385,749 | A * | 1/1995 | Serpelloni et al. | 426/658 |
| 6,050,064 | A * | 4/2000 | Yuyama et al. | 53/514 |
| 6,557,945 | B1 * | 5/2003 | Eric | 30/124 |
| 6,722,545 | B2 * | 4/2004 | Yuyama et al. | 225/96.5 |
| 6,823,980 | B2 * | 11/2004 | Fujimoto et al. | 198/400 |
| 6,857,346 | B1 * | 2/2005 | McLean | 83/169 |
| 6,938,530 | B1 * | 9/2005 | Fujimoto et al. | 83/420 |
| 7,000,815 | B1 * | 2/2006 | Tipton et al. | 225/103 |
| 7,536,938 | B2 * | 5/2009 | Kim | 83/74 |
| 7,673,778 | B2 * | 3/2010 | Sze | 225/104 |
| 7,934,355 | B2 * | 5/2011 | Strub et al. | 53/55 |
| 2002/0179666 | A1 * | 12/2002 | Buckley et al. | 225/1 |
| 2002/0179669 | A1 * | 12/2002 | Buckley et al. | 225/103 |
| 2003/0005800 | A1 * | 1/2003 | Czarnek et al. | 83/24 |
| 2003/0019900 | A1 * | 1/2003 | Dienst | 225/104 |
| 2003/0034373 | A1 * | 2/2003 | Yuyama et al. | 225/96.5 |
| 2003/0084574 | A1 * | 5/2003 | Eric | 30/124 |
| 2006/0016157 | A1 * | 1/2006 | Thurston et al. | 53/435 |
| 2006/0201985 | A1 * | 9/2006 | Sze | 225/104 |
| 2007/0228053 | A1 * | 10/2007 | Darst | 220/694 |
| 2013/0125722 | A1 * | 5/2013 | Omura et al. | 83/104 |
| 2014/0174271 | A1 * | 6/2014 | Omura et al. | 83/361 |

OTHER PUBLICATIONS

Chinese Office Action dated Jan. 13, 2014. English Translation Included.

* cited by examiner 421
419
10
428
432
427
432
427c
464
463
431
420
463
463
465
441
440
461
462
463
461
10b
10a

TABLET SPLITTING APPARATUS

TECHNICAL FIELD

The present invention relates to a tablet splitting apparatus configured to cut a tablet to split the tablet into several split tablet pieces.

BACKGROUND ART

Some tablet splitting apparatuses according to the related art configured to split a tablet into two pieces press a cutter downward onto a tablet being held alone to cut the tablet. Japanese Unexamined Patent Application Publication No. Hei 11-226088 describes a tablet feeding apparatus configured to split a tablet using a single swingable cutter blade to individually discharge split tablet pieces. Further, Japanese Unexamined Patent Application Publication No. Hei 11-226089 discloses a tablet feeding apparatus configured to cut a tablet being held using a cutter blade into upper and lower pieces to first discharge the lower split tablet piece with the upper split tablet piece temporarily retained on the cutter and then discharge the upper split tablet piece later along with a next cutter operation. In such tablet feeding apparatuses, a single cutter blade provided to a cutting mechanism is caused to cut into a tablet to be split being held at a cutting position by a holding mechanism.

RELATED ART DOCUMENT

Patent Document

Patent Document 1: Japanese Patent Application Publication No. 11-226088

SUMMARY OF INVENTION

Technical Problem

In the tablet splitting apparatuses according to the related art, the edge of a substantially straight blade is vertically pressed onto a tablet like an ax, for example, to cut the tablet, whether the tablet is to be split into left and right pieces or upper and lower pieces. While this cutting technique is convenient, the cutting technique may produce unwanted fragments in addition to targeted split tablet pieces. When such unwanted fragments are produced, fluctuations in weight of the split tablet pieces may be increased.

Even if fluctuations in weight of the cut pieces fall within an allowable range determined by a medical prescription, visually recognizable fluctuations may make a medicine taker feel anxious. Thus, significant fluctuations in weight of the cut pieces are not preferable. In addition, even if the frequency of occurrence of undesirable splitting that exceeds the allowable range determined by the prescription falls within an allowable range determined by the specifications of the apparatus, the amount of medicine to be discarded without being used because of such undesirable splitting may be increased.

An object of the present invention is to provide a tablet splitting apparatus capable of reducing fluctuations in weight of a plurality of split tablet pieces obtained by splitting a tablet.

Solution to Problem

The present invention provides a tablet splitting apparatus including: a holding mechanism capable of holding a tablet to be split at a cutting position; a cutting mechanism capable of cutting the tablet held at the cutting position; and cutting operation regulating section for regulating operating steps of the cutting mechanism and the holding mechanism. A structure of the cutting mechanism and the operating steps of the cutting mechanism and the holding mechanism regulated by the cutting operation regulating section are determined such that fluctuations in weight of two split tablet pieces obtained by splitting the tablet are small. Fluctuations in weight of the plurality of split tablet pieces obtained by splitting the tablet are significantly reduced by making the structure of the cutting mechanism suitable and making the operating steps of the cutting mechanism and the holding mechanism regulated by the cutting operation regulating section suitable.

A variety of configurations may be used as the configuration of the cutting mechanism. In addition, the operating steps regulated by the cutting operation regulating section may differ according to the cutting mechanism and the holding mechanism. For example, the cutting mechanism may include a pair of opposed blades each displaceable between a movement stand-by position and a movement completion position, and may be configured to cut the tablet located at the cutting position by displacing both of the opposed blades in the pair from the movement stand-by position to the movement completion position. In this case, the operating steps regulated by the cutting operation regulating section are preferably as follows. First, when both of the opposed blades in the pair are displaced from the movement stand-by position to the movement completion position, the holding mechanism continuously holds the tablet until the tablet is caught between the pair of opposed blades. Then, after the tablet has been caught between the pair of opposed blades, the holding mechanism releases the tablet and only the pair of opposed blades hold the tablet. After the holding mechanism releases the tablet, the pair of opposed blades are caused to cut into the tablet.

With this configuration, the tablet to be split is held at the cutting position by the holding mechanism, and thereafter cut by the pair of opposed blades by reducing the gap therebetween. In this event, when the tablet is caught between the pair of opposed blades, the holding mechanism releases the tablet before the pair of opposed blades are caused to cut into the tablet, and the opposed blades are caused to cut into the tablet with only the pair of opposed blades holding the tablet. In this way, the tablet has been spaced apart from the holding mechanism when the pair of opposed blades are caused to cut into the tablet to cut the tablet. Thus, even if the tablet is deformed or displaced when the pair of opposed blades are caused to cut into the tablet, no reaction force due to such deformation or displacement is applied from the holding mechanism to the tablet. If such a reaction force were applied to the tablet at a position asymmetric with reference to the pair of opposed blades, cracks caused in the tablet ahead of the tips of the pair of opposed blades might be curved or increased in size. The position of occurrence and the magnitude of the reaction force might be varied due to the presence or absence of a minute chip at the surface of the tablet, a crack in the surface of or inside the tablet, a fragment produced from the tablet cut earlier in time is presented between the tablet and the holding mechanism, and so forth, and if any, due to the location of the chip, crack, fragment, etc. In contrast, according to the present invention, since the pair of opposed blades are caused to cut into the tablet when the tablet is spaced apart from the holding mechanism and only the pair of opposed blades hold the tablet, no reaction force is produced. As a result, a split line is stabilized and differences in weight of the split tablet pieces are reduced.

Preferably, the cutting operation regulating section regulates the operating steps such that when the holding mechanism releases the tablet, displacement of the pair of opposed blades is temporarily stopped until the holding mechanism completely releases the tablet. With this configuration, constraints on the timing for operation of the holding mechanism to release the tablet are relieved or resolved, promoting facilitation of mechanism design, a reduction in number of man-hours for adjustment, a reduction in material cost, and so forth.

The cutting operation regulating section may regulate the operating steps such that when the holding mechanism releases the tablet, one or both of an operation in which the holding mechanism is moved away from the tablet caught between the pair of opposed blades and an operation in which the tablet is moved away from the holding mechanism by moving the pair of opposed blades catching the tablet in a direction away from the holding mechanism. This configuration makes it easy for the holding mechanism to release the tablet.

A tablet passage configured to guide the tablet to the holding mechanism may be structured in any way. For example, the tablet passage may vertically extend by forming a portion of the tablet passage upstream of the cutting position with a cylindrical member vertically extending, to allow the tablet to fall directly downward. Meanwhile, a falling tablet guiding member having a surface inclined to face obliquely upward may also be used. The cutting position and the holding mechanism may be disposed in the middle of the tablet passage. If the falling tablet guiding member having a surface inclined to face obliquely upward is used, a significant impact is not applied to the falling tablet, and the tablet is stopped at the cutting position in a good posture. As a result, differences in weight of the split tablet pieces may be reduced. However, requests for improvement of the tablet splitting apparatus demand not only to improve the splitting accuracy, that is, to reduce the differences in weight of the split tablet pieces, but also to support various tablets of a wide variety of shapes. In order to address such requests, preferably, the tablet splitting apparatus further includes a falling tablet guiding member, a groove depth regulating member, a path thickness adjusting mechanism, and a control device. The falling tablet guiding member may include a groove-shaped tablet falling path operable to guide the tablet falling by gravity and having an upper-end opening portion, a lower-end opening portion, and a side-surface opening portion located between the upper-end opening portion and the lower-end opening portion, wherein the cutting position is located in a middle of the tablet falling path. The groove depth regulating member may be capable of covering a part of or the entire side-surface opening portion of the tablet falling path, the side-surface opening portion including a portion of the tablet falling path upstream of the cutting position. The path thickness adjusting mechanism may be capable of changing a relative distance between a groove bottom of the tablet falling path opposite to the side-surface opening portion and a groove bottom facing surface of the groove depth regulating member. The control device may be capable of acquiring thickness information on a thickness of the tablet to actuate the path thickness adjusting mechanism to adapt the relative distance to the thickness of the tablet. With this configuration, by providing the control device with thickness information indicating the smallest dimension included in tablet shape information, the relative distance between the groove bottom of the tablet falling path and the groove bottom facing surface of the groove depth regulating member can thereafter be automatically adapted to the thickness of the tablet through cooperation among the control device, the thickness adjusting mechanism, and the groove depth regulating member. Therefore, the burden of modification and adjustment for adaptation to various tablets of different thicknesses can be reduced. In this case, if a groove-like tablet falling path formed on a surface inclined to face obliquely upward is used as the tablet falling path, the falling speed of the tablet is suppressed by the groove bottom to relieve the impact exerted on the tablet. In addition, the posture of the tablet is corrected by the groove bottom to allow the tablet to be stopped at the cutting position in a good posture, contributing to reducing differences in weight of the split tablet pieces.

Preferably, the holding mechanism includes a receiving member disposed in the tablet falling path to partially block the tablet falling path to temporarily hold the tablet to be split, which has fallen down along the tablet falling path, at the cutting position, and the control device controls the receiving member and the cutting mechanism such that operations of the receiving member and the cutting mechanism are associated with each other. Preferably, the holding mechanism further includes a groove width adjusting mechanism provided in a portion of the tablet falling path upstream of the cutting position to adjust a groove width of the tablet falling path. In this case, the control device may acquire width information on a width of the tablet to actuate the groove width adjusting mechanism to adapt the groove width to the width of the tablet. With this configuration, by providing the control device with width information indicating the middle dimension included in the tablet shape information, the groove width of the tablet falling path can thereafter be automatically adjusted to the width of the tablet through cooperation between the control device and the width adjusting mechanism. Therefore, the burden of modification and adjustment for adaptation to various tablets of different dimensions including not only thickness but also width can be reduced.

Preferably, the cutting mechanism is configured to space the tablet from the groove bottom of the tablet falling path opposite to the side-surface opening portion in a process in which the pair of opposed blades are displaced from the movement stand-by position to the movement completion position, and to accomplish cutting of the tablet thereafter. If the posture of the tablet during a fall or at the cutting position is stabilized by the groove bottom etc. and then the tablet is moved away from the groove bottom before the pair of opposed blades are caused to cut into the tablet to cut the tablet, the posture of the tablet is not regulated by the groove bottom any more but exclusively regulated by the pair of opposed blades. If the pair of opposed blades are caused to cut into the tablet after the posture of the tablet is adapted to cutting by the pair of opposed blades, the symmetry of forces applied to the tablet by the pair of opposed blades during cutting is enhanced. In addition, the tablet does not receive a reaction force from the groove bottom. Thus, the tablet is split stably, and the differences in weight of the split tablet pieces are reduced.

The pair of opposed blades may be disposed such that one of the pair of opposed blade is displaced through the groove bottom and the other is displaced through the groove depth regulating member. When the tablet in contact with the groove bottom is held between the pair of opposed blades, when the tablet held between the pair of opposed blades is raised from the groove bottom, and further when the pair of opposed blades holding the tablet raised from the groove bottom are caused to cut into the tablet, it is not preferable to abruptly apply a strong force or strongly cut into the tablet. Thus, preferably, the cutting mechanism is configured such that one or both of the pair of opposed blades are retracted within a movable range when the one or both of the pair of opposed blades are pushed toward the movement stand-by position by an external force, and the one or both of the pair of opposed blades are biased to be advanced by a force stronger than the weight of the tablet during such retraction from the start of or in the middle of the retraction. That is, initially the tablet is held and shallow cuts are formed on the surfaces of the tablet with a gentle force corresponding to the biasing force, and thereafter the cutting force is increased in the movable range, e.g. at the movable limit. With this configuration, the tablet is split stably, and the differences in weight of the split tablet pieces are reduced.

If the posture of the tablet during a fall or during a halt at the cutting position is stabilized by the groove bottom etc. of an inclined surface and then a portion of the tablet falling path upstream of the cutting position is inclined also with respect to a plane extending along a plumb line and orthogonally intersecting the inclined surface, the inclination of such a portion of the tablet falling path is gentler than that of the steepest path on the inclined surface over which a spherical body naturally rolls down without constraints. The posture of the falling tablet is corrected and the falling speed of the tablet is suppressed by two surfaces, namely the groove bottom and the groove sidewall surface. Thus, the differences in weight of the split tablet pieces are further reduced.

Preferably, a portion of the tablet falling path upstream of the cutting position is meandering. For example, the portion of the tablet falling path upstream of the cutting position may be bent in a crank shape, or may be repeatedly bent to be meandering. With this configuration, the tablet is decelerated at a bent portion of the meandering path. Therefore, the falling tablet is decelerated each time the tablet passes through a bent portion of the tablet falling path to prevent speeding, and the tablet temporarily strongly hits a wall surface surrounding the tablet falling path to enhance posture correction performed by a corner portion formed between the groove sidewall surface and the groove bottom. As a result, the differences in weight of the split tablet pieces are further reduced.

The tablet falling path may be branched at or downstream of the cutting position to form a portion of the tablet falling path downstream of a branch point into two branch paths. In this case, the receiving member may include two path opening-closing members. The two path opening-closing members may be provided in the vicinity of the branch point between the two branch paths to open and close the corresponding branch paths. Moreover, the two path opening-closing members may be separately disposed on both sides of the cutting position. With this configuration, by suitably opening and closing the two path opening-closing members, the two split tablet pieces separated on both sides of the cutting position can be dropped and discharged to respective locations of use at suitable timings. Therefore, the accurately split tablet pieces can be distributed to the left and right branches, for example, to be fed to different locations to be effectively used.

The control device may be configured to choose whether the split tablet pieces obtained by splitting the tablet are caused to fall into the same branch path or different branch paths by switching the temporal order of a time at which the pair of opposed blades of the cutting mechanism are retracted from the movement completion position to the movement stand-by position after the tablet has been split and a time at which the two path opening-closing members open the corresponding branch paths. If the control device is configured in this way, the split tablet pieces can be fed to the same location and distributed to different locations in a freely switchable manner. Moreover, such a feature can be embodied by merely improving the control device without adding a mechanical component or a driving member.

The cutting mechanism may include a pair of opposed blades each displaceable between a movement stand-by position and a movement completion position, and may be configured to cut the tablet located at the cutting position by displacing the pair of opposed blades from the movement stand-by position to the movement completion position by relatively moving the pair of opposed blades in opposite directions while keeping the pair of opposed blades in parallel with each other. In such a cutting mechanism, the pair of opposed blades catching the tablet are caused to cut into the tablet from both sides. Therefore, each blade cuts into the tablet for half the depth, and the tablet is symmetrically deformed on the front and back sides, compared to a case where a blade cuts into the tablet only from one side. Thus, both the frequency of occurrence of fragments and the amount of such fragments are reduced. Moreover, the pair of opposed blades are caused to cut into the tablet while being relatively displaced in the parallel direction, and thus the edges of the blades are pressed into the tablet obliquely rather than vertically. Therefore, the blades cut well as with a knife cutting an object while being pulled, for example. Thus, both the frequency of occurrence of fragments and the amount of such fragments are further reduced. Thus, an efficient tablet splitting apparatus with simple blades that produces few fragments can be provided by using the cutting mechanism.

The cutting mechanism may include a four-bar parallel link, and the pair of opposed blades may be provided on two opposite sides of the four-bar parallel link. As a result, complication of the cutting mechanism can be avoided or suppressed. If such a cutting mechanism is used, the holding mechanism may include a receiving member capable of temporarily holding the tablet to be split at the cutting position. The tablet splitting apparatus may further include: tablet position adjusting section for adjusting the cutting position of the tablet with respect to the pair of opposed blades by moving the receiving member, and information acquiring section for acquiring medicine information on the tablet. The control device may actuate the tablet position adjusting section based on the medicine information acquired by the information acquiring section, and may further control the receiving member and the cutting mechanism such that operations of the receiving member and the cutting mechanism are associated with each other. With this configuration, the position at which the tablet to be split is received is automatically adjusted based on the medicine information. As a result, even a variety of tablets of different shapes can be automatically cut at appropriate locations.

A disk-like rotary blade configured to cut into the tablet while rotating may be used as the cutting mechanism. Use of the rotary blade is expected to reduce occurrence of fragments and produce only a stable minute amount of dust which is produced in place of fragments. In order to provide a tablet splitting apparatus in which the cutting mechanism incorporates a rotary blade with good cutting performance, the holding mechanism may include a tablet transfer mechanism capable of feeding the held tablet to the cutting position. The tablet transfer mechanism may include a rotatable member capable of rotating about a rotary shaft and a driving member capable of driving the rotatable member. The rotatable member may include a plurality of tablet receiving portions provided in an outer peripheral portion centered about the rotary shaft and disposed at equal intervals in a circumferential direction to receive the tablet. The rotatable member may also have an annular groove formed in the outer peripheral portion to continuously extend in the circumferential direction, the groove communicating with the plurality of tablet receiving portions and allowing the rotary blade to partially enter thereinto to cut the tablet held in the tablet receiving portion. The tablet transfer mechanism may be configured such that the tablet is put into the tablet receiving portion when the tablet receiving portion comes to a tablet feed position, and the tablet which has been split is discharged from the tablet receiving portion when the tablet receiving portion comes to a tablet discharge position.

In such a tablet splitting apparatus, the tablet transfer mechanism includes the rotatable member and the driving member, the tablet receiving portions provided in the rotatable member can hold and feed the tablet, and the groove in the outer periphery of the rotatable member enables cutting by the rotary blade. Thus, the tablet transfer mechanism has been simplified. Moreover, the tablet receiving portions and the groove are basically not deformed. Thus, no adjustment is required or the tablet is not caught to be scrubbed as long as the tablet receiving portions and the groove are formed as designed. Thus, the tablet transfer mechanism of the holding mechanism is simple and adjustment-free, providing an inexpensive tablet splitting apparatus with good cutting performance.

BRIEF DESCRIPTION OF DRAWINGS

FIG. 1 is a schematic view illustrating the effect of a tablet splitting apparatus according to the present invention in contrast to apparatuses according to the related art, in which

FIG. 2 shows the structure of a tablet splitting apparatus with vertical blades according to a first embodiment of the present invention, in which

FIG. 7 shows the structure of a tablet splitting apparatus with transverse blades according to a second embodiment of the present invention, in which

FIG. 8 shows a tablet splitting apparatus with vertical blades with a different structure according to a third embodiment of the present invention, in which

FIG. 9 shows the structure of a tablet splitting apparatus configured to split a tablet into a different number of pieces according to a fourth embodiment of the present invention, in which

FIG. 10 shows the structure of a tablet splitting apparatus according to a fifth embodiment of the present invention, in which

FIG. 14 shows the structure of an essential portion of a tablet splitting apparatus according to a sixth embodiment of the present invention, in which

FIG. 19 shows the structure of an essential portion of a tablet splitting apparatus according to an eighth embodiment of the present invention, in which

FIG. 20 shows the structure of a tablet splitting apparatus according to a ninth embodiment of the present invention, in which

FIG. 25 shows the structure of a tablet splitting apparatus according to a twelfth embodiment of the present invention, in which

FIG. 26 shows the structure of an essential portion of a tablet splitting apparatus according to a thirteenth embodiment of the present invention, in which

DESCRIPTION OF EMBODIMENTS

Tablet splitting apparatuses according to a plurality of embodiments of the present invention will be described below with reference to the drawings. In the illustrated embodiments, for the sake of clarity etc., fasteners such as bolts, couplers such as hinges, electric circuits such as motor drivers, and electronic circuits such as controllers are not shown in detail.

[First Embodiment]

Figure 1A:
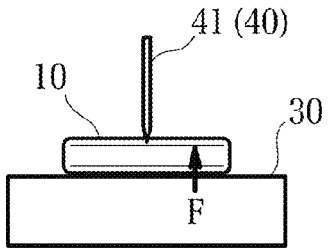
FIG. 1*a* is a front view of an essential portion of an apparatus according to the related art with a single blade.
Figure 1B:
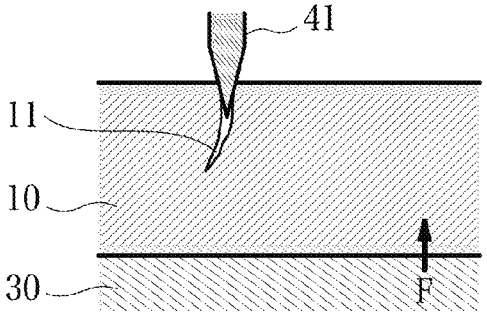
FIG. 1*b* is an enlarged cross-sectional view of a cutting portion of the apparatus of FIG. 1*a*.
Figure 1C:
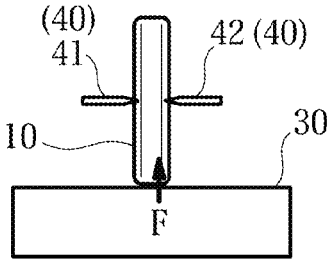
FIG. 1*c* is a front view of an essential portion of an apparatus according to the related art with opposed blades.
Figure 1D:
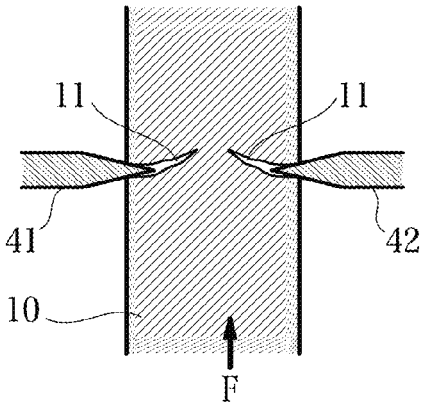
FIG. 1*d* is an enlarged cross-sectional view of a cutting portion of the apparatus of FIG. 1*c*.

A specific configuration of a tablet splitting apparatus according to a first embodiment of the present invention will be described. As a precondition for understanding the first embodiment, a problem that occurs in cutting a tablet with a structure according to the related art will be described with reference to FIG. 1. If a tablet 10 is in contact with a holding mechanism 30 when a blade 41 is caused to cut into the tablet 10, a reaction force F is applied from the holding mechanism 30 to the tablet 10 because of deformation or displacement of the tablet 10, whether a single blade is used (see FIGS. 1*a* and 1*b*) or a pair of opposed blades are used (see FIGS. 1*c* and 1*d*). If the reaction force F is applied to the tablet 10 at a position asymmetric with reference to the blades 41 and 42 crack 11 caused in the tablet 10 ahead of the tips of the blades 41 and 42 may be curved or increased in size. The position of occurrence and the magnitude of the reaction force F may be varied due to the presence or absence of a minute chip at the surface of the tablet 10, a crack in the surface of or inside the tablet 10, a fragment produced form the tablet cut earlier in time between the tablet 10 and the holding mechanism 30, and so forth, and if any, due to the location of the chip, crack, fragment, etc.

Figure 1E:
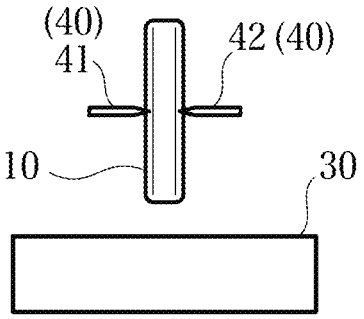
FIG. 1*e* is a front view of an essential portion of an apparatus according to the present invention with opposed blades.
Figure 1F:
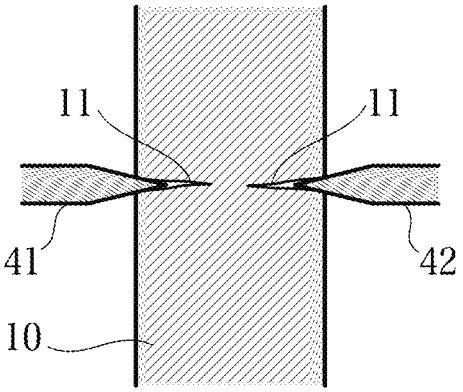
FIG. 1*f* is an enlarged cross-sectional view of a cutting portion of the apparatus of FIG. 1*e*.

In the first embodiment of the present invention described below, the pair of opposed blades 41 and 41 are caused to cut into the tablet 10 with the tablet 10 spaced apart from the holding mechanism 30 and with only the pair of opposed blades 41 and 42 holding the tablet 10 (see FIGS. 1*e* and 1*f*). According to the first embodiment, the reaction force F, which is considered to be a factor that varies the cutting state and a factor that amplifies the amount of fluctuation, is not produced. As a result, a split line is stabilized and differences in weight of the split tablet pieces are reduced.

Figure 2A:
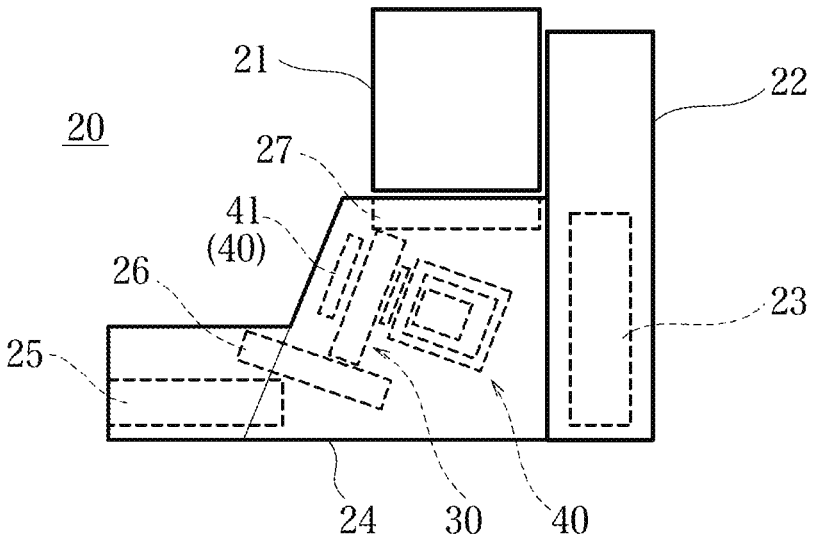
FIG. 2*a* is an overall side view and FIG. 2*b* is a perspective view of a main body portion with a side panel removed.
Figure 2B:
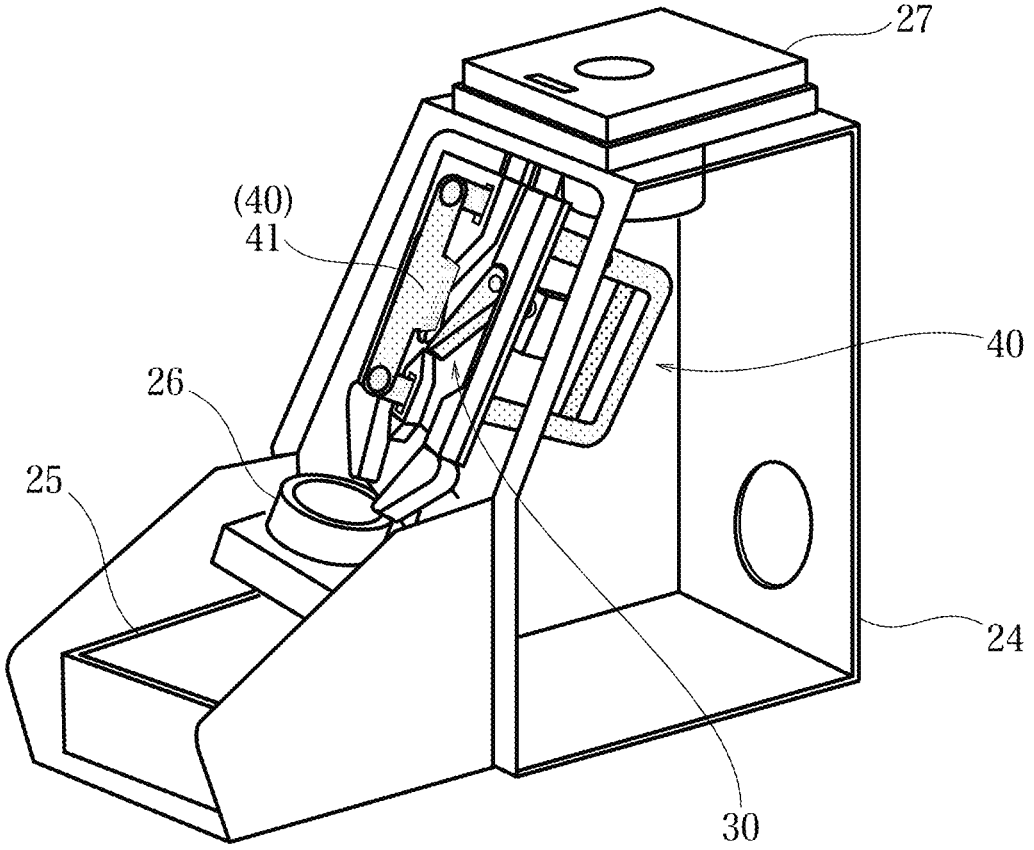
Figure 3A:
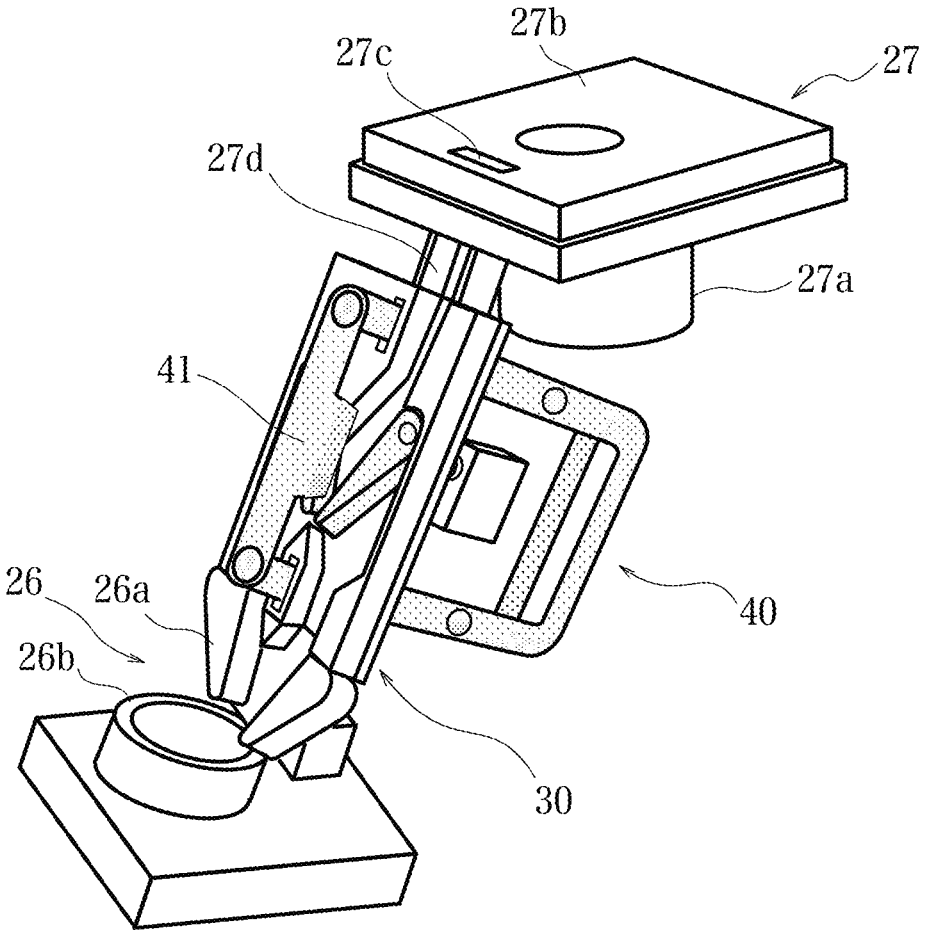
FIG. 3*a* is a perspective view of mechanisms inside the main body portion.
Figure 3B:
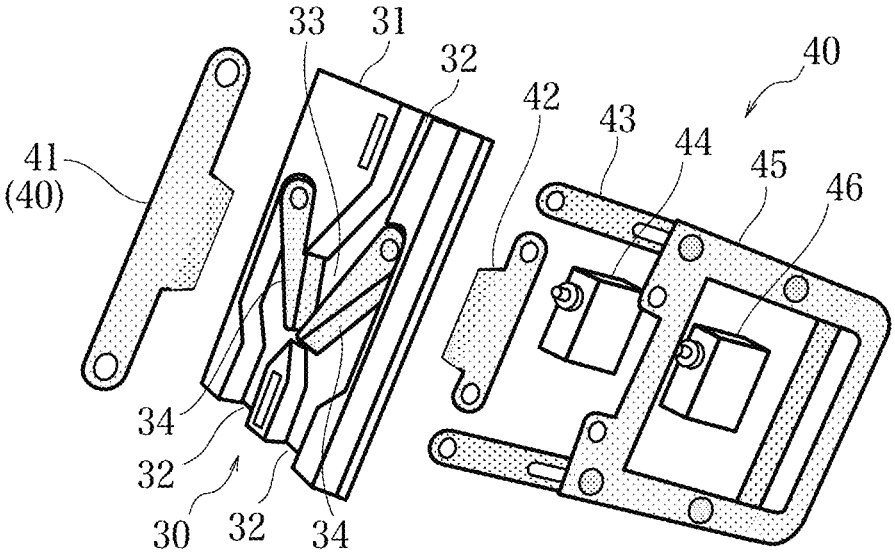
FIG. 3*b* is a developed perspective view of a holding mechanism and a cutting mechanism.
Figure 4A:
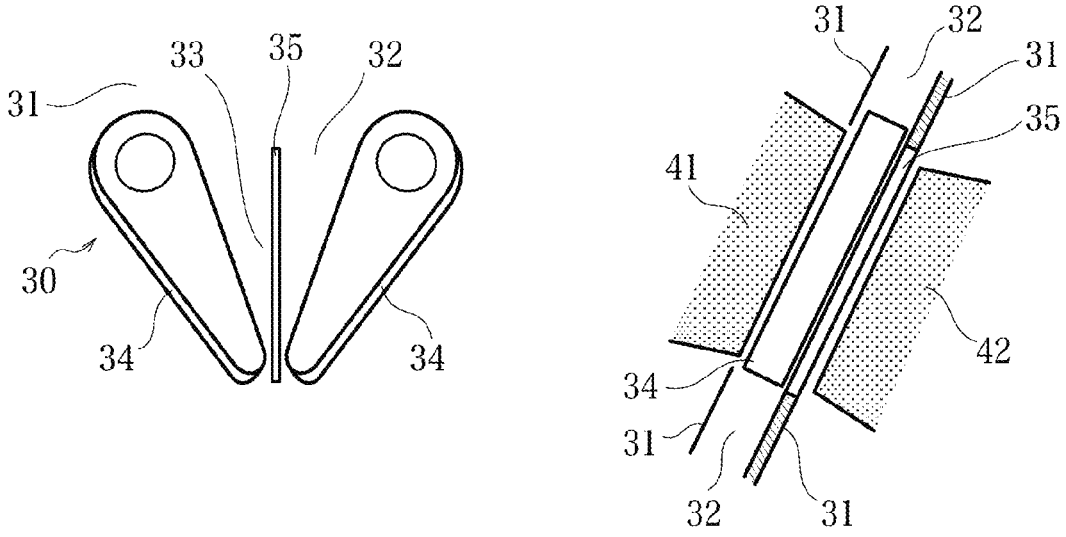
FIGS. 4*a* to 4*c* each show a front view of an essential portion of the holding mechanism in the left half, and a vertical section of an essential portion of the holding mechanism and a side view of the opposed blades in the right half.
Figure 4B:
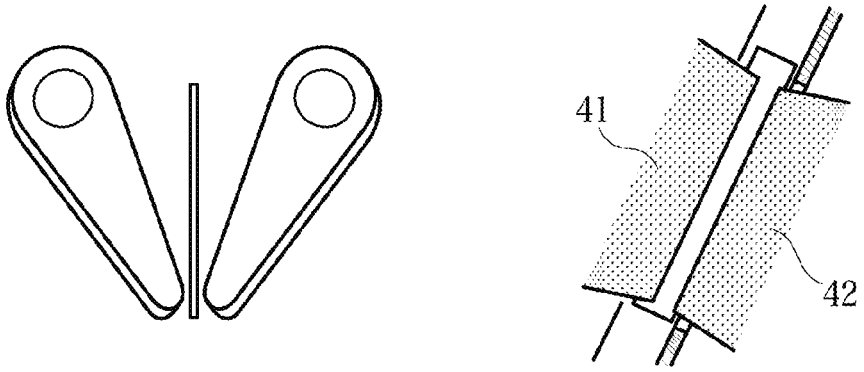
Figure 4C:
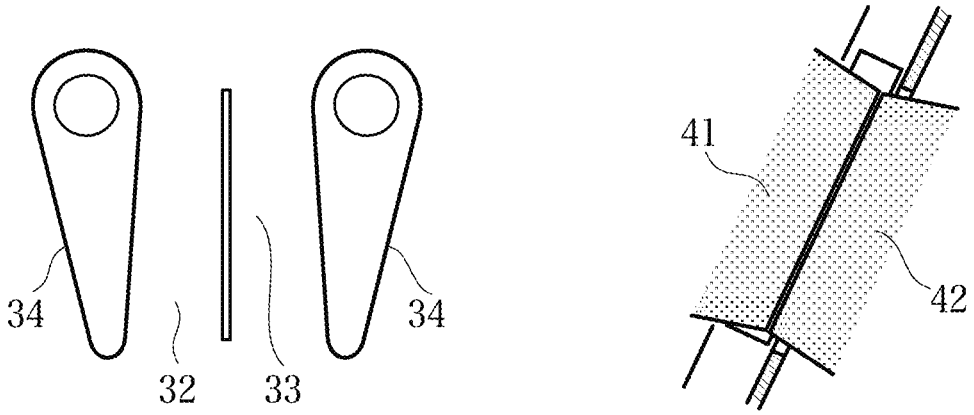
Figure 5A:
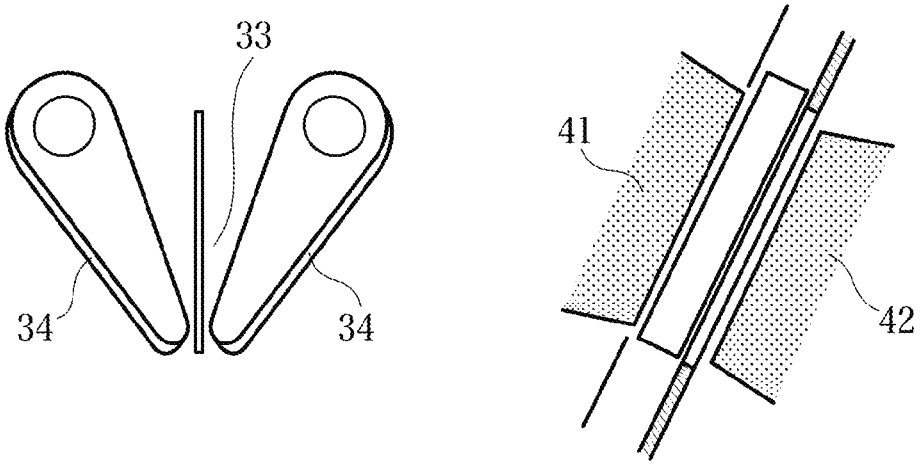
FIGS. 5*a* to 5*c* each show a front view of an essential portion of the holding mechanism in the left half, and a vertical section of an essential portion of the holding mechanism and a side view of the opposed blades in the right half.
Figure 5B:
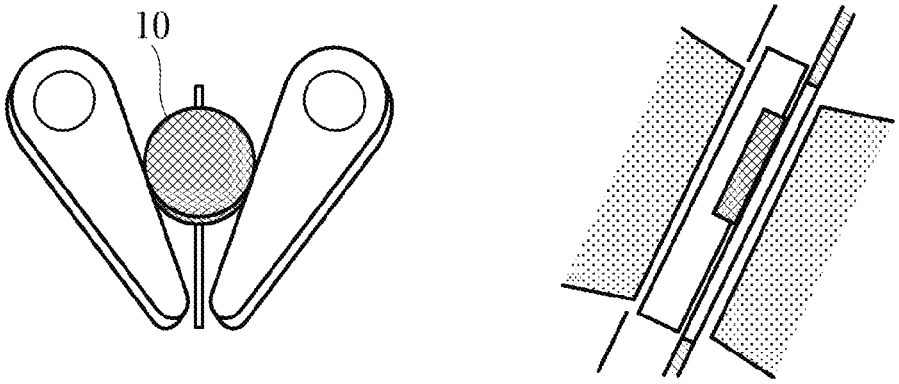
Figure 5C:
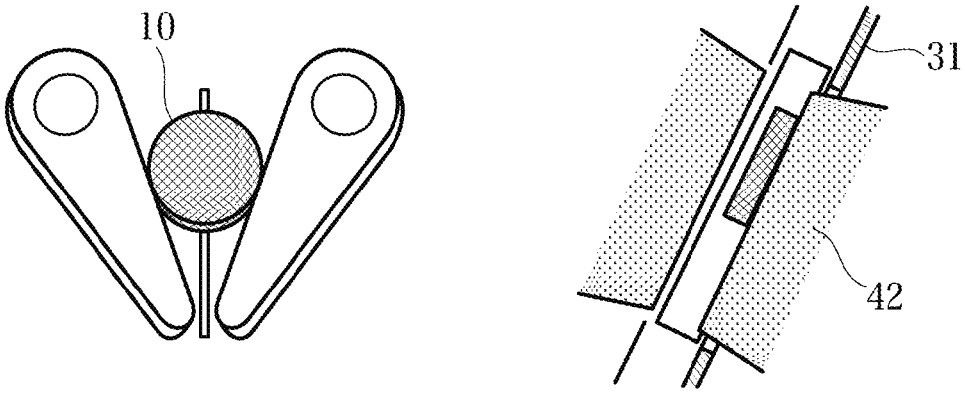
Figure 6A:
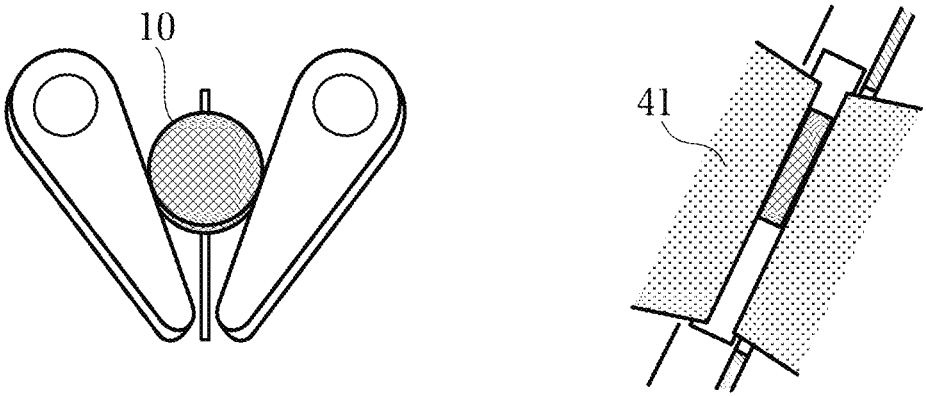
FIGS. 6*a* to 6*c* each show a front view of an essential portion of the holding mechanism in the left half, and a vertical section of an essential portion of the holding mechanism and a side view of the opposed blades in the right half.
Figure 6B:
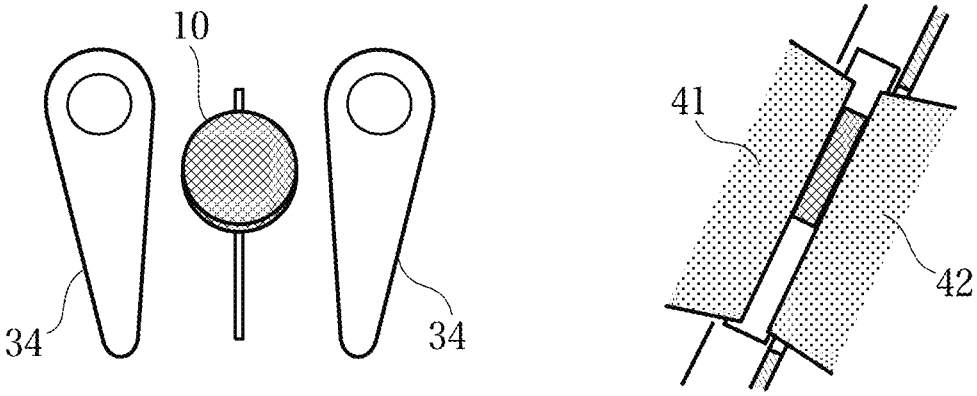
Figure 6C:
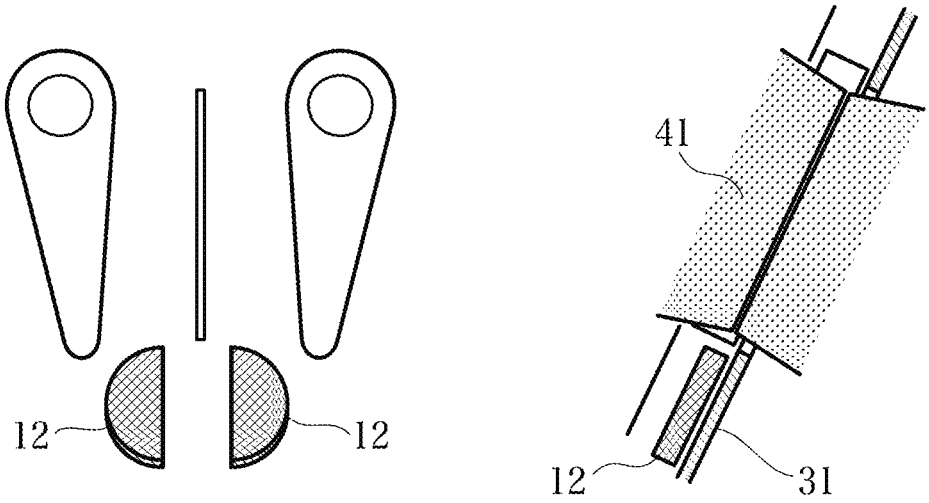

FIG. 2*a* is an overall side view of a tablet splitting apparatus 20 with vertical blades in which a pair of opposed blades 41 and 42 are disposed to cut a tablet in a tablet passage vertically along the path, and FIG. 2*b* is a schematic perspective view of a main body portion 24 with a side panel removed. FIG. 3*a* is a perspective view of mechanisms inside the main body portion 24 of the tablet splitting apparatus 20, and FIG. 3*b* is a developed perspective view of a holding mechanism 30 and a cutting mechanism 40. Further, FIGS. 4*a* to 4*c* each show a front view of an essential portion of the holding mechanism 30 in the left half, and a vertical section of the essential portion of the holding mechanism 30 and a side view of the opposed blades 41 and 42 in the right half.

The tablet splitting apparatus 20 (see FIG. 2*a*) includes a tablet cassette 21, an operation portion 22, controller 23, the main body portion 24, a receiving container 25*a* relay portion 26, and a tablet feeder base portion 27. The main body portion 24 includes the tablet feeder base portion 27, the relay portion 26, and the receiving container 25 in addition to the holding mechanism 30 and the cutting mechanism 40. The operation portion 22 is externally provided with a device operable to set the number of tablets to be processed, a process start button, etc. (not shown), and internally provided with the controller 23, a power source portion, etc. (not shown). The tablet cassette 21 is removably mounted to the tablet feeder base portion 27 to discharge the tablets 10 one by one. The main body portion 24 and the operation portion 22 may be integrated with each other. In the example, however, the operation portion 22 is coupled to the rear of the main body portion 24 to facilitate manufacture, maintenance, etc. Support portions for the receiving container 25 and the relay portion 26 may be formed as units separable from the main body portion 24. In the example, however, the support portions are integral with the main body portion 24.

The tablet feeder base portion 27 is fixedly disposed at the uppermost portion of the main body portion 24 (see FIGS. 1 and 3). The holding mechanism 30 is disposed in the main body portion 24 at a position below the tablet feeder base portion 27 and close to the front surface of the main body portion 24. The relay portion 26 is fixedly disposed below the holding mechanism 30. Further, the receiving container 25 is ejectably disposed below the relay portion 26. The cutting mechanism 40 is mounted in the main body portion 24 to orthogonally intersect the space in which the holding mechanism 30 is disposed, that is, such that a part of the cutting mechanism 40 penetrates through the holding mechanism 30.

The tablet feeder base portion 27 (see FIG. 3*a*) allows automatic successive feeding of the tablets 10. In the tablet feeder base portion 27, a driving motor 27*a* is driven according to control by the controller 23 to cause the tablet cassette 21 mounted to a base plate 27*b* to discharge the tablet 10. Then, the tablet feeder base portion 27 feeds the tablet 10 to a tablet passage 32 of the holding mechanism 30 by way of an introduction port 27*c* and a guide 27*d*.

The holding mechanism 30 holds the tablet 10 to be split at a cutting position 33. The cutting mechanism 40 cuts the tablet 10 held by the holding mechanism 30 to split the tablet 10 into two split tablet pieces 12 (see FIG. 3).

The relay portion 26 (see FIG. 3*a*) includes a collecting guide 26*a* and a shock-absorbing buffer 26*b* to feed the split tablet pieces 12 to the receiving container 25 while preventing the split tablet pieces 12 which have fallen from the tablet passage 32 of the holding mechanism 30 from being scattered or broken.

The receiving container 25 (see FIG. 2) is a container in the form of a rectangular box or a rectangular pan to receive and store the split tablet pieces 12 formed by splitting the tablet 10. In the embodiment, the receiving container 25 can be drawn out.

In the example, the holding mechanism 30 (see FIGS. 3 and 4) also releases the tablet 10 in cooperation with the cutting mechanism 40, in addition to holding the tablet 10 to be split at the cutting position 33. Thus, the holding mechanism 30 includes a plate-like falling tablet guiding member 31 disposed between the tablet feeder base portion 27 and the relay portion 26, and a pair of receiving members 34 each formed from a movable member having a lower end portion swingable about its upper end portion. The falling tablet guiding member 31 is inclined with its upper end displaced rearward and with its lower end displaced forward. The inclination angle of the falling tablet guiding member 31 is about 45° to 60° from a horizontal line, for example. The tablet passage 32 continuously extending from the upper guide 27*d* to the lower guide 26*a* is formed by engraving in the front surface of the falling tablet guiding member 31 facing obliquely upward.

The inclination of the falling tablet guiding member 31 is set such that the tablet 10 slides down in the tablet passage 31 at a moderate speed without departing from the falling tablet guiding member 31.

The tablet passage 32 is wider at the cutting position 33. A vertical slit 35 (see FIG. 4) is formed to penetrate through the center of the cutting position 33. The pair of receiving members 34 are disposed on both sides of the slit 35. When a driving member (not shown) on the back surface of the falling tablet guiding member 31 is driven according to control by the controller 23, the lower end portions of the pair of receiving members 34 are turned over a predetermined angular range in the tablet passage 32. When the pair of receiving members 34 are turned to bring their lower end portions closer to each other, a V-shaped receiving structure is formed at a location immediately below the cutting position 33 to close the tablet passage 32 (see FIGS. 4*a* and 4*b*). When the lower end portions of the pair of receiving members 34 are moved away from each other, the tablet passage 32 is opened at a location below the cutting position 33 (see FIG. 4*c*).

The cutting mechanism 40 (see FIGS. 3 and 4) includes a pair of opposed blades 41 and 42 formed as an outer blade provided on the front side and an inner blade provided on the back side, respectively, and operable to be advanced and retracted with respect to the cutting position 33. That is, the cutting mechanism 40 includes a pair of opposed blades 41 and 42 each displaceable between a movement stand-by position (position of the pair of opposed blades 41 and 42 shown in FIG. 4*a*) and a movement completion position (position of the pair of opposed blades 41 and 42 shown in FIG. 4*b*), and is configured to cut the tablet 10 located at the cutting position by displacing both of the opposed blades 41 and 42 in the pair from the movement stand-by position to the movement completion position. In the example, the opposed blades 41 and 42 extend vertically. The pair of opposed blades 41 and 42 are not disposed to extend along a plumb line, but are inclined at the same angle as that of the falling tablet guiding member 31. That is, one opposed blade 41 is located obliquely above, and the other opposed blade 42 is located obliquely below. The one opposed blade 41 is supported by a first advancing-retracting member 43 configured to partially penetrate through the falling tablet guiding member 31 to perform reciprocal motion. When a first driving member 44 is driven according to control by the controller 23, the one opposed blade 41 is moved between the movement stand-by position and the movement completion position. The other opposed blade 42 is supported by a second advancing-retracting member 45 provided behind the falling tablet guiding member 31 to perform reciprocal motion. When a second driving member 46 is driven according to control by the controller 23, the other opposed blade 42 is moved between the movement stand-by position and the movement completion position while passing through the slit 35.

The controller 23 forms a control device formed from a programmable microprocessor system or sequencer, for example. The controller 23 also forms cutting operation regulating section for regulating operating steps of the holding mechanism 30 and the cutting mechanism 40. In the embodiment, the cutting operation regulating section formed by the controller 23 regulates the operating steps as follows. First, in reducing the gap between the pair of opposed blades 41 and 42 to cut the tablet 10, the holding mechanism 30 continuously holds the tablet 10 until the tablet 10 located at the cutting position 33 is caught between the pair of opposed blades 41 and 42. Next, after the tablet 10 has been caught between the pair of opposed blades 41 and 42, the operation of reducing the gap between the pair of opposed blades 41 and 42 is temporarily stopped. After that, the holding mechanism 30 releases the tablet 10 and only the pair of opposed blades 41 and 42 hold the tablet 10. Then, after the holding mechanism 30 completely releases the tablet 10, the operation of reducing the gap between the pair of opposed blades 41 and 42 is resumed to cause the pair of opposed blades 41 and 42 to cut into the tablet 10. Other contents of control will be illustrated along with operation control described below.

The mode of use and operation of the tablet splitting apparatus 20 according to the first embodiment will be described with reference to the drawings. FIGS. 5*a* to 5*c* and FIGS. 6*a* to 6*c* each show a front view of an essential portion of the holding mechanism 30 in the left half, and the essential portion of the holding mechanism 30 and a side view of the pair of opposed blades 41 and 42 in the right half, chronologically showing the tablet cutting operation.

In the initial state (see FIG. 5*a*), the receiving members 34 located immediately below the cutting position 33 are closed, and no tablet 10 is provided in the holding mechanism 30 and the cutting mechanism 40 to leave the cutting position 33 unoccupied. In addition, the one opposed blade 41 has been retracted outward, or forward and upward, from the cutting position 33 (located at the movement stand-by position), and the other opposed blade 42 has been retracted inward, or rearward and downward, from the cutting position 33 (located at the movement stand-by position). Thus, the gap between the pair of opposed blades 41 and 42 has been maximally widened.

In this state, when the operation portion 22 is operated to cause the tablet splitting apparatus 20 to start a cutting process, the driving motor 27*a* of the tablet feeder base portion 27 is driven. When the driving motor 27*a* is driven, one tablet 10 is dropped and discharged from the tablet cassette 21.

Then, the tablet 10 is put into the tablet passage 32 of the holding mechanism 30 through the introduction port 27*c* and the guide 27*d* of the tablet feeder base portion 27. When the tablet 10 is guided by the tablet passage 32 to reach the cutting position 33, the tablet 10 contacts the receiving members 34 to be stopped. As a result, the tablet 10 is positioned and held at the center between the two receiving members 34 (see FIG. 5*b*). At this time, the tablet 10 is held in the holding mechanism 30 by the inner bottom surface of the tablet passage 32 of the falling tablet guiding member 31 and portions of the two receiving members 34 in contact with the tablet 10, and located in the gap between the pair of opposed blades 41 and 42 without contacting the pair of opposed blades 41 and 42.

Next (see FIG. 5*c*), the other opposed blade 42 is slightly advanced toward the one opposed blade 41. When the tablet 10 is pushed by the other opposed blade 42 to be raised apart from the inner bottom surface of the tablet passage 32, the other opposed blade 42 is stopped.

Then (see FIG. 6*a*), the one opposed blade 41 is advanced toward the other opposed blade 42. When the gap between the pair of opposed blades 41 and 42 is reduced and the tablet 10 is caught between the opposed blades 41 and 42, the one opposed blade 41 is stopped.

Thereafter (see FIG. 6*b*), the pair of receiving members 34 are turned away from each other to open the tablet passage 32, and moved away from the tablet 10. At this time, the tablet 10 has been held by the pair of opposed blades 41 and 41 and thus does not fall which is undesirable.

From that state, further (see FIG. 6*c*), both of the opposed blades 41 and 42 in the pair are advanced until the gap between the opposed blades 41 and 42 becomes substantially zero (the pair of opposed blades 41 and 42 are moved to the movement completion position). Consequently, the tablet 10 is vertically cut into left and right split tablet pieces 11 at this time, the tablet 10 is cut into with only the pair of opposed blades 41 and 42 holding the tablet 10. Therefore, an undesired reaction force F is not applied from the holding mechanism 30 to the tablet 10 even if the tablet 10 is more or less deformed or displaced by the cutting, allowing the tablet 10 to be stably split as expected. Then, while the two split tablet pieces 12 formed by splitting the tablet 10 fall into the receiving container 25 through the tablet passage 31 and the relay portion 26, the pair of receiving members 34 are turned to bring their distal ends closer to each other to close the tablet passage 31 and both of the opposed blades 41 and 42 in the pair are retracted to the movement stand-by position to return to the initial state (see FIG. 5*a*).

[Second Embodiment]

Figure 7A:
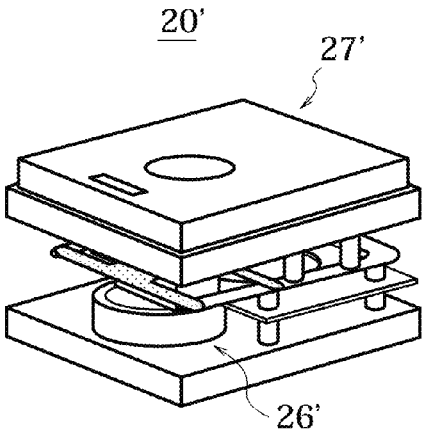
FIG. 7*a* is an overall perspective view.
Figure 7B:
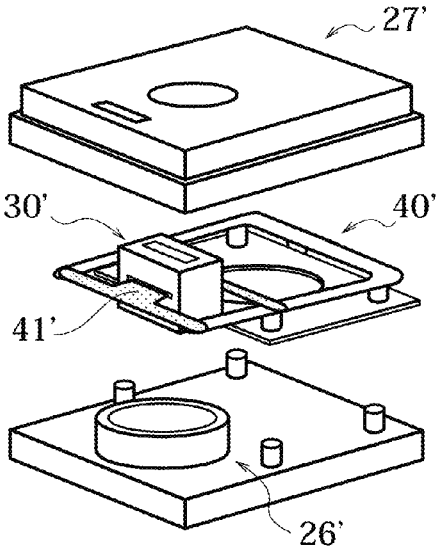
FIG. 7*b* is a developed perspective view.
Figure 7C:
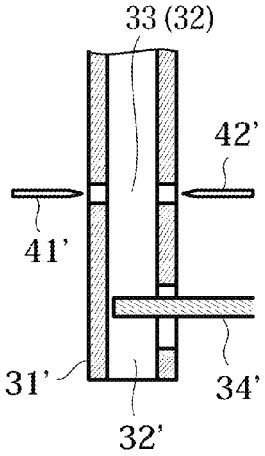
FIGS. 7*c* to 7*i* show a vertical section of an essential portion of a holding mechanism and a side view of opposed blades.
Figure 7D:
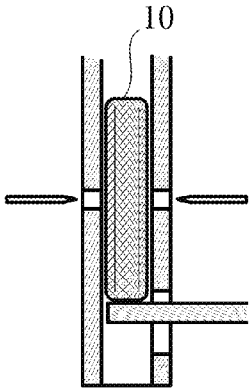
Figure 7E:
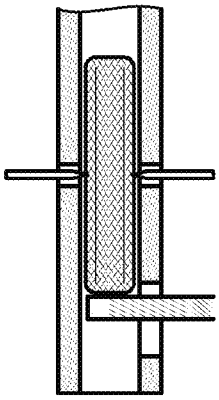
Figure 7F:
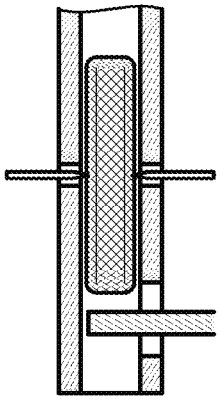
Figure 7G:
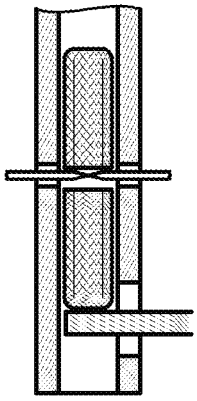
Figure 7H:
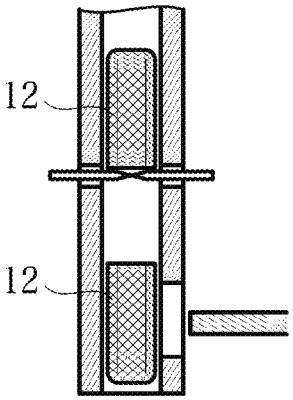
Figure 7I:
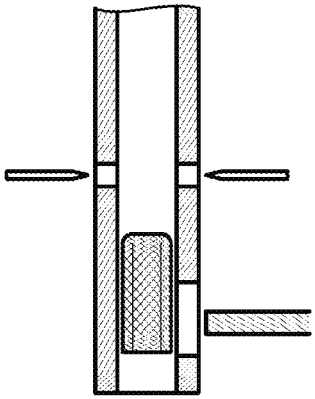

A specific configuration of a tablet splitting apparatus according to a second embodiment of the present invention will be described with reference to the drawings. FIG. 7*a* is an overall perspective view of a tablet splitting apparatus 20' with transverse blades in which a pair of opposed blades are moved with respect to a tablet to block a tablet passage, FIG. 7*b* is a developed perspective view of the tablet splitting apparatus 20', and FIG. 7*c* shows a vertical section of an essential portion of a holding mechanism 30' and a side view of opposed blades 41' and 42'.

The tablet splitting apparatus 20' differs from the tablet splitting apparatus 20 according to the first embodiment discussed above in the following points (see FIGS. 7*a* to 7*c*). The holding mechanism 30' or a cutting mechanism 40' is not inclined. The holding mechanism 30' extends along a plumb line. Both one opposed blade 41' and the other opposed blade 42' extend horizontally. The entire cutting mechanism 40' including first and second advancing-retracting members and first and second driving members (not shown) extends horizontally. Further, the receiving container 25 is not provided. A feeder base portion 27' that may be disposed in a tablet storage of a tablet dispensing device is provided in place of or along with the standard tablet feeder base portion 27. In order to reduce the height of the holding mechanism 30' and the tablet splitting apparatus 20', a receiving member 34' is formed from a single member capable of horizontal reciprocal motion with respect to a tablet passage 32' extending along a plumb line to advance and retract the distal end portion of the receiving member 34' from a side and also capable of vertical movement.

The mode of use and operation of the tablet splitting apparatus 20' according to the second embodiment will be described with reference to the drawings. FIGS. 7*c* to 7*i* each show a vertical section of the essential portion of the holding mechanism 30' and a side view of the one pair of opposed blades 41' and 42', chronologically showing the tablet cutting operation.

In this case, in the initial state (see FIG. 7*c*), the receiving member 34' has entered the tablet passage 32' at a location immediately below a cutting position 33'. However, no tablet 10 is provided in the holding mechanism 30' or the cutting mechanism 40' to leave the cutting position 33' unoccupied. In addition, the one opposed blade 41' has been retracted outward, or forward, from the cutting position 33', and the other opposed blade 42' has been retracted inward, or rearward (to the movement stand-by position), from the cutting position 33'. Thus, the gap between the pair of opposed blades 41' and 42' has been widened. In this state, when the tablet splitting apparatus 20' is caused to start a cutting process, one tablet 10 is dropped and discharged from the tablet cassette 21 (FIG. 1).

Then, the tablet 10 is put into the tablet passage 32' of the holding mechanism 30', and guided by the tablet passage 32' to reach the cutting position 33'. After that, the tablet 10 contacts the receiving member 34' to be stopped, and is positioned and held on the receiving member 34' (see FIG. 7*d*).

At this time, the tablet 10 is held in the holding mechanism 30' by the inner wall surface of the tablet passage 32' of the falling tablet guiding member 31' and the upper surface of the receiving member 34', and located in the gap between the pair of opposed blades 41' and 42' without contacting the pair of opposed blades 41' and 42'.

Next (see FIG. 7*e*), both of the opposed blades 41' and 42' in the pair are advanced toward the cutting position 33', and the gap between the opposed blades 41' and 42' is accordingly reduced. When the edges of the pair of opposed blades 41' and 42' are further advanced into the tablet passage 32' to contact the tablet 10, the pair of opposed blades 41' and 42' are stopped, and the tablet 10 is caught between the pair of opposed blades 41' and 42'. Thereafter (see FIG. 7*f*), the receiving member 34' is lowered apart from the tablet 10. However, the tablet 10 is held by the pair of opposed blades 41' and 42', and thus does not fall which is undesirable. In this state, in addition, the tablet 10 is placed at the center of the tablet passage 32' by the pair of opposed blades 41' and 42' to be spaced away from the inner wall surfaces of the tablet passage 32' by play for passage. Thus, the tablet 10 is held by only the pair of opposed blades 41' and 42'.

From that state, further (see FIG. 7*g*), both of the opposed blades 41' and 42' in the pair are advanced until the gap between the opposed blades 41' and 42' is reduced to become substantially zero. Consequently, the tablet 10 is horizontally cut into upper and lower split tablet pieces 11 at this time, the tablet 10 is cut into with only the pair of opposed blades 41' and 42' holding the tablet 10. Therefore, an undesired reaction force F is not applied from the holding mechanism 30' to the tablet 10 even if the tablet 10 is more or less deformed or displaced by the cutting, allowing the tablet 10 to be stably split as expected. Then, the upper half tablet of the two split tablet pieces 12 formed by splitting the tablet 10 stays on the opposed blades 41' and 42', and the lower half tablet stays on the receiving member 34'.

Thus, if the split tablet pieces 11 are caused to successively fall down one by one, first (see FIG. 7*h*), the receiving member 34' is retracted out of the tablet passage 32' to cause only the lower half tablet to fall down. Next (see FIG. 7*i*), both of the opposed blades 41' and 42' in the pair are retracted out of the tablet passage 32' to cause the upper half tablet to fall down. If the two split tablet pieces 11 are caused to collectively fall down, such operations are performed at the same time. Then, when all the split tablet pieces 12 have fallen down, the receiving member 34' enters the tablet passage 32' and is elevated to return to the initial state (see FIG. 7*c*).

In this way, also in this case, the pair of opposed blades 41' and 42' are caused to cut into the tablet 10 with only the pair of opposed blades 41' and 42' holding the tablet 10, allowing the tablet 10 to be stably split as expected.

[Third Embodiment]

Figure 8A:
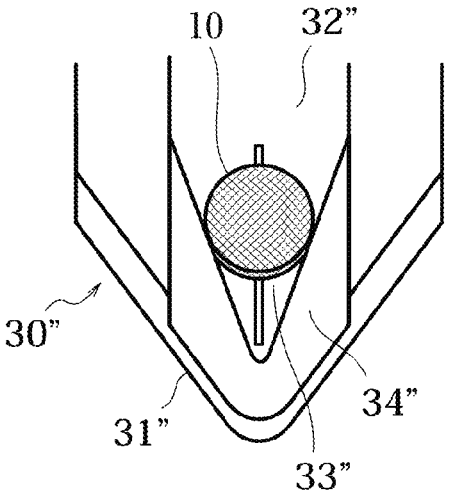
FIG. 8*a* is a front view of an essential portion of a holding mechanism and FIG. 8*b* shows a vertical section of the essential portion of the holding mechanism and a side view of opposed blades.
Figure 8B:
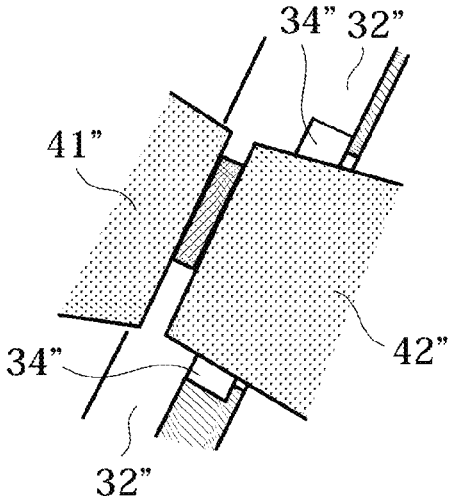

A specific configuration of a tablet splitting apparatus according to a third embodiment of the present invention will be described with reference to the drawings. FIG. 8 shows an example of a tablet splitting apparatus with vertical blades with another structure, in which FIG. 8*a* is a front view of an essential portion of a holding mechanism 30", and FIG. 8*b* shows a vertical section of the essential portion of the holding mechanism 30" and a side view of a pair of opposed blades 41" and 42".

The tablet splitting apparatus differs from the tablet splitting apparatus 20 according to the first embodiment discussed above in that a receiving member 34" is a fixed member rather than a movable member, and that release of a tablet being held is achieved by translating the pair of opposed blades 41" and 42" and does not depend on operation of the receiving member 34" any more.

Specifically, a step capable of retaining the tablet 10 at a cutting position 33" is fixedly formed on the inner bottom of a tablet passage 32". More particularly, the tablet passage 32" is formed to be deeper at the cutting position 33" and a portion upstream of the cutting position 33" than at the receiving member 34". A portion of the tablet passage 32" downstream of the cutting position 33" is formed on the receiving member 34" such that the upper surface of the receiving member 34" serves as the bottom surface of the passage, and thus formed to be shallower by the thickness of the receiving member 34".

In this case, the tablet 10 which has been retained at the cutting position 33" by the receiving member 34" is held by the pair of opposed blades 41" and 42", and thereafter the pair of opposed blades 41" and 42" are significantly moved toward one opposed blade 41". Specifically, the pair of opposed blades 41" and 42" are moved over a distance longer than the thickness of the receiving member 34". This allows the tablet 10 to be disengaged from the receiving member 34" to be held by only the pair of opposed blades 41" and 42". Thereafter, when the gap between the pair of opposed blades 41" and 42" is reduced to cause the pair of opposed blades 41" and 42" to cut into the tablet 10, the tablet 10 is split into a plurality of split tablet pieces 12. The split tablet pieces 12 slide over the upper surface of the receiving member 34" or pass above the receiving member 34" to fall down.

In this way, in this case, release of the tablet 10 being held by the holding mechanism 30" is executed by moving the pair of opposed blades 41" and 42" holding the tablet 10 to move the tablet 10 away from the holding mechanism 30".

[Fourth Embodiment]

Figure 9A:
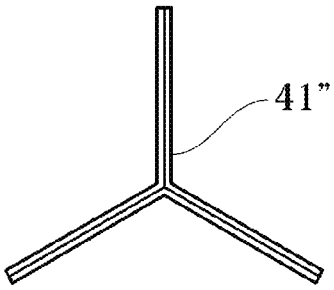
FIG. 9*a* shows the shape of the edges of blades for splitting into three pieces.
Figure 9B:
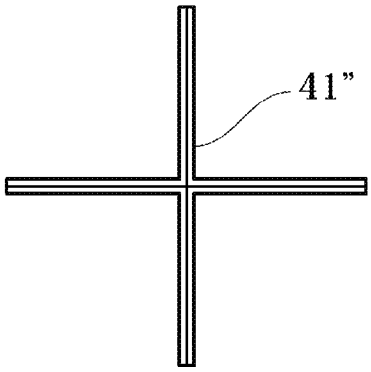
FIG. 9*b* shows the shape of the edges of blades for splitting into four pieces.

A specific configuration of a tablet splitting apparatus according to a fourth embodiment of the present invention will be described with reference to the drawings. FIG. 9 shows an example of the structure of a tablet splitting apparatus configured to split a tablet into more than two pieces, in which FIG. 9*a* shows the shape of the edges of blades for splitting into three pieces, and FIG. 9*b* shows the shape of the edges of blades for splitting into four pieces.

The tablet splitting apparatus according to the present invention is not limited to splitting the tablet 10 into two split tablet pieces 12 (half tablets) as in each of the embodiments discussed above, and may split the tablet 10 into a larger number of split tablet pieces 12 in one cutting operation by mounting an advanceable-retractable blade (see FIG. 9) having blade edges, the number of which corresponds to the number of pieces to be formed after splitting, disposed to extend radially to a cutting mechanism (not shown). One or both of the pair of opposed blades 41" and 42" and the receiving member may be vertically moved for position adjustment to appropriately split tablets 10 of different diameters relatively easily.

[Other Embodiments]

Other modified embodiments in which release of the tablet 10 held by the holding mechanism 30 according to the first embodiment is performed by only operation of the holding mechanism 30 will be described, although not shown. For example, a portion of the falling tablet guiding member 31 including the cutting position 33 may be configured to be movable away from the tablet 10 as the receiving members 34 open to move away from the tablet 10. This allows the holding mechanism 30 to release the tablet 10 just by causing the holding mechanism 30 to move away from the tablet 10 held by the pair of opposed blades 41 and 42.

In the tablet splitting apparatus 20 according to the first embodiment, in cutting the tablet 10, the other opposed blade 42 is first advanced, the one opposed blade 41 is next advanced, further the receiving members 34 are moved away from the tablet 10, and thereafter the pair of opposed blades 41 and 42 are caused to cut into the tablet 10. However, cutting operation steps are not limited thereto. For example, the one opposed blade 41 may first be advanced, the other opposed blade 42 may next be advanced, further the receiving members 34 may be moved away from the tablet 10, and thereafter the pair of opposed blades 41 and 42 may be caused to cut into the tablet 10. Alternatively, the one opposed blade 41 may first be advanced, the receiving members 34 may next be moved away from the tablet 10, further the other opposed blade 42 may be advanced, and thereafter the pair of opposed blades 41 and 42 may be caused to cut into the tablet 10. If the receiving members 34 open to move away from the tablet 10 at a sufficiently high speed, the one opposed blade 41 may not necessarily be temporarily stopped when the pair of opposed blades 41 and 42 holding the tablet 10 are caused to cut into the tablet 10.

The operation portion 22 is not essential, and a sequence of cutting operations may be started in response to the tablet 10 reaching the cutting position 33, for example. Indication of the operating state may be present or absent. The controller 23 is not essential, and the cutting operation regulating section may be incorporated into the holding mechanism or the cutting mechanism rather than be embodied by the controller 23. For example, the holding mechanism or the cutting mechanism may be sequentially driven by a mechanism such as a cam or a link.

The receiving container 25 and the relay portion 26 are also not essential if the split tablet pieces 11 are discharged without trouble. If automatic successive feeding of the tablets 10 is not necessary, the tablet feeder base portion 27 and the tablet cassette 21 are also not essential.

Further, it is not essential that the first and second driving members 44 and 46 for the pair of opposed blades 41 and 41 and driving members for the pair of receiving members 34 should be expressly defined as being electrically driven, fluidly driven, etc. The driving members may be incorporated into a power transmission portion of the holding mechanism or the cutting mechanism, or the like. For example, the first and second advancing-retracting members 43 and 45 and the pair of receiving members 34 may be driven by an operation of pressing or rotating a manual handle.

Although the tablet passage 32 is open upward in the holding mechanism 30 of the tablet splitting apparatus 20 shown, the tablet passage 32 may be provided with a cover configured to prevent a tablet from being scattered.

In order to obtain appropriate cutting results for various tablets 10, the holding mechanism 30 or the cutting mechanism 40 may be provided with an adjustment mechanism configured to vary the operating state of the pair of receiving members 34, the pair of opposed blades 41 and 42, etc. according to the difference in shape or material among the tablets 10.

Further, such adjustment may be easily performed by setting parameters of the controller 23, through a select operation performed using the operation portion 22, etc.

The tablet splitting apparatus according to the present invention may be incorporated into a tablet passage extending downward from a single tablet feeder or a tablet collecting path formed by merging tablet passages extending downward from a plurality of tablet feeders, besides being used in a stand-alone configuration as in the first embodiment discussed above or incorporated into an automated medicine dispenser such as a tablet dispensing device to replace a tablet feeder base portion while expanding the functionality of thereof as in the second embodiment discussed above.

[Fifth Embodiment]

A fifth embodiment shown in FIGS. 10 to 13 is suitable to split a disk-like tablet. A sixth embodiment shown in FIG. 14 is a modification of the fifth embodiment, and is suitable to split an elongated tablet. Also in the drawings, as in FIGS. 1 to 9, for the sake of clarity etc., fasteners such as bolts, couplers such as hinges, driving sources such as electric motors, power transmission members such as gears, electric circuits such as motor drivers, and electronic circuits such as controllers are not shown in detail, and components necessary for or related to description of the embodiments are mainly shown.

Figure 10A:
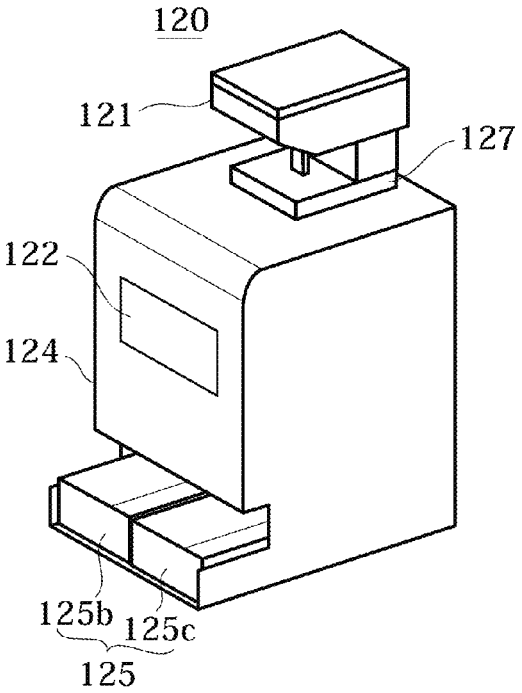
FIG. 10*a* is a perspective view showing the appearance of the apparatus.
Figure 10B:
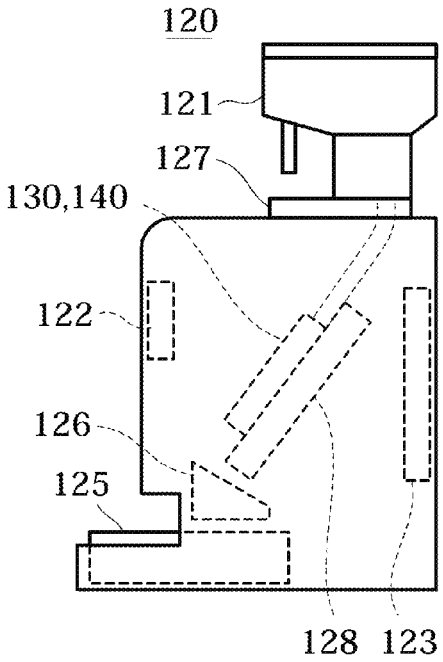
FIG. 10*b* is a right side view.
Figure 10C:
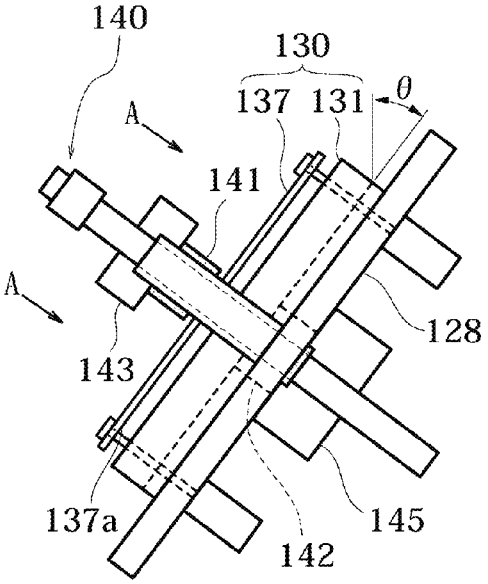
FIG. 10*c* is a right side view of a holding mechanism and a cutting mechanism.
Figure 10D:
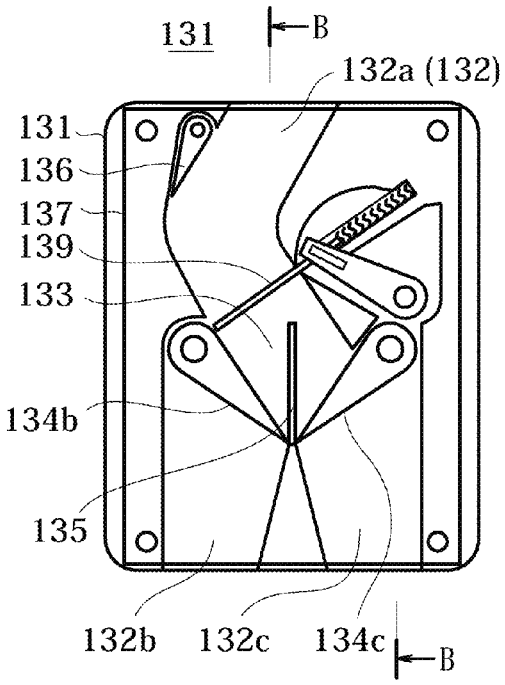
FIG. 10*d* is a plan view of the holding mechanism (as seen in the direction of the arrows A).
Figure 11A:
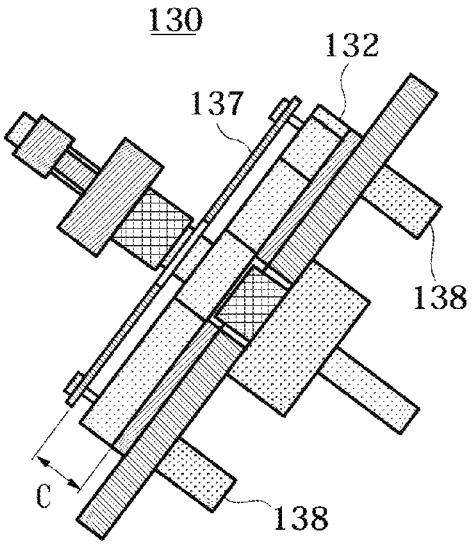
FIGS. 11*a* and 11*b* are each a cross-sectional view of the holding mechanism and the cutting mechanism taken along the line B-B.
Figure 11B:
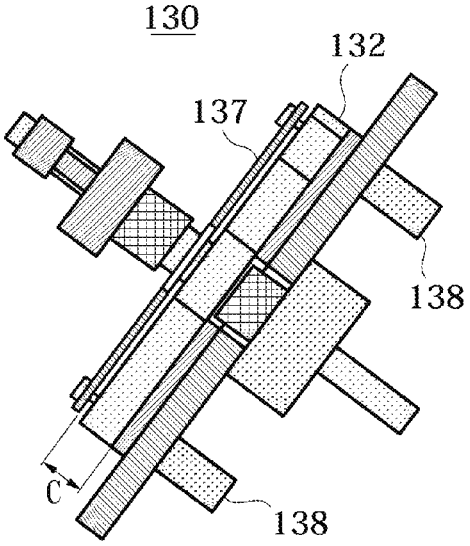
Figure 11C:
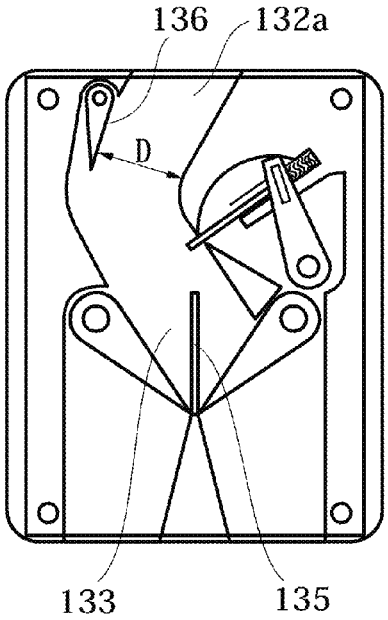
FIG. 11*c* is a plan view of the holding mechanism.
Figure 11D:
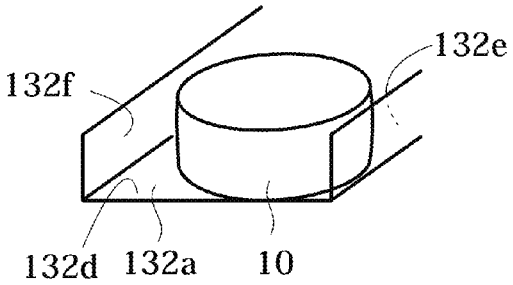
FIGS. 11*d* and 11*e* are each a schematic view of a tablet falling path and a falling tablet.
Figure 11E:
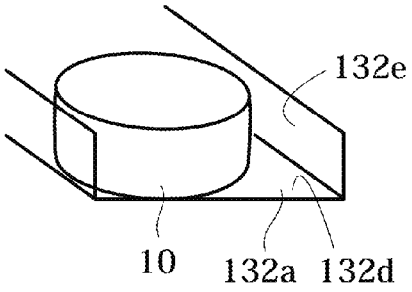

FIG. 10*a* is a perspective view showing the appearance of a tablet splitting apparatus 120, FIG. 10*b* is a right side view of the tablet splitting apparatus 120, FIG. 10*c* is a right side view of a holding mechanism 130 and a cutting mechanism 140, and FIG. 10*d* is a plan view of the holding mechanism 130 (as seen in the direction of the arrows A). FIGS. 11*a* and 11*b* are each a cross-sectional view of the holding mechanism 130 and the cutting mechanism 140 taken along the line B-B, FIG. 11*c* is a plan view of the holding mechanism 130, and FIGS. 11*d* and 11*e* are each a schematic view of a falling tablet 10 sliding down a tablet falling path 132. Further, FIGS. 11*a* to 12*f* are each a right side view of an essential portion of the cutting mechanism 140, and FIGS. 13*a* to 13*d* are each a plan view of an essential portion of the holding mechanism 130.

The tablet splitting apparatus 120 according to the fifth embodiment (see FIGS. 10*a* and 10*b*) includes a tablet cassette 121, an operation portion 122 controller 123 (control device), a main body portion 124, a receiving container 125, a relay portion 126, a tablet feeder base portion 127, an inclined frame 128, the holding mechanism 130, the cutting mechanism 140, and a power source portion (not shown). Among these, the controller 123, the relay portion 126, the inclined frame 128, the holding mechanism 130, the cutting mechanism 140, and the power source portion are build in the main body portion 124. The operation portion 121 and the tablet feeder base portion 127 are fixedly mounted to the main body portion 124 to expose an operation surface and a cassette mounting surface to the outer surface of the housing. The tablet cassette 121 is removably mounted to the tablet feeder base portion 127. The receiving container 125 is inserted to be drawable from a front opening at the bottom portion of the main body portion 124.

The tablet feeder base portion 127 is fixedly disposed at the uppermost portion of the main body portion 124 (see FIG. 10*b*). The inclined frame 128 is disposed at the center portion of the main body portion 124 in a rearwardly inclined posture, that is, with the upper end portion displaced rearward and upward and with the lower end portion displaced forward and downward. The relay portion 126 is fixedly disposed below the inclined frame 128. The receiving container 125 is ejectably provided below the relay portion 126.

At the center portion of the main body portion 124, the holding mechanism 130 and the cutting mechanism 140 are attached to the inclined frame 128 (see FIGS. 10*b* and 10*c*). The holding mechanism 130 is in a rearwardly inclined posture as with the inclined frame 128, and the cutting mechanism 140 is in a forwardly inclined posture to be perpendicular to the holding mechanism 130.

The tablet feeder base portion 127 and the tablet cassette 121 mounted to the tablet feeder base portion 127 (see FIGS. 10*a* and 10*b*) allow automatic successive feeding of the tablets 10. When a driving motor of the tablet feeder base portion 127 is driven according to control by the controller 123, the tablets 10 are discharged one by one from the tablet cassette 121 mounted to a base plate. The tablet 10 is fed to the tablet falling path 132 of the holding mechanism 130 to be discussed later by way of a guide such as a duct. In order to prevent erroneous mounting of the tablet cassette 121 and automatically acquire information on the shape of the tablet 10 etc., the tablet feeder base portion 127 in the example is configured to read cassette identification information and tablet information from a data carrying medium such as a data carrier mounted to the tablet cassette 121 to deliver the information to the controller 123. That is, the tablet feeder base portion 127 forms means for acquiring tablet information.

When the tablet 10 to be split is dropped from the tablet cassette 121 by way of the tablet feeder base portion 127 and the guide to enter an upstream path 132*a* of the tablet falling path 132, the holding mechanism 130 (see FIGS. 10*b* to 10*d* and 11) temporarily holds the tablet 10 at a cutting position 133 using receiving members 134. The cutting mechanism 140 (see FIGS. 10*b* to 10*d* and 13) cuts the tablet 10 at a slit 135 at the cutting position 133 to split the tablet 10 into two split tablet pieces 10*b* and 10*c*. The relay portion 126 (see FIG. 10*b*) includes a collecting guide and a shock-absorbing buffer. The relay portion 126 is configured to feed the split tablet piece 10*b*, which has fallen from a left branch path 132*b* of the tablet falling path 132 of the holding mechanism 130, to a left receiving container 125*b* and feed the split tablet piece 10*c*, which has fallen from a right branch path 132*c* of the tablet falling path 132 of the holding mechanism 130, to a right receiving container 125*c*.

The receiving container 125 (see FIGS. 10*a* and 10*b*) is a container in the form of a rectangular box or a rectangular pan to receive and store the split tablet pieces 10*b* and 10*c* formed by splitting the tablet 10. If all the split tablet pieces 10*b* and 10*c* are to be collectively received, a single wide container is used as the receiving container 125. In the embodiment, however, the left receiving container 125*b* configured to receive the left split tablet piece 10*b*, of the left and right pieces obtained by splitting the tablet 10, and the right receiving container 125*c* configured to receive the right split tablet piece 10*c* are arranged on the left and right sides to be inserted into the main body portion 124. The receiving container 125 and the relay portion 126 configured to guide the split tablet pieces 10*b* and 10*c* to the receiving container 125 may be units separable from the main body portion 124. In the embodiment, however, the relay portion 126 is integral with the main body portion 124 for ease of transportation of the apparatus etc. The operation portion 121 and the controller 123 may also be separable from the main body portion 124. In the embodiment, still, the operation portion 121 and the controller 123 are integrated with the main body portion 124 for ease of transportation of the apparatus etc.

The holding mechanism 130 (see FIGS. 10 and 11) includes a plate-like falling tablet guiding member 131 and the pair of receiving members 134. The falling tablet guiding member 131 is disposed between the tablet feeder base portion 127 and the relay portion 126 to allow the holding mechanism 130 to release the tablet 10 in cooperation with the cutting mechanism 140, in addition to retaining the tablet 10 to be split at the cutting position 133 in the middle of the tablet falling path 132 in preparation for being cut by the cutting mechanism 140 as discussed above. The pair of receiving members 134 are each formed from a movable member having a lower end portion turnable about its upper end portion. The embodiment additionally includes a width adjusting mechanism 136, a groove depth regulating member 137, and a thickness adjusting mechanism 138 to regulate the posture and the direction of the tablet 10 which has fallen down. The embodiment further includes a stand-by member 139 to retain a next tablet 10 at a location immediately upstream of the tablet 10 being cut. These members and mechanisms 134, 136, 137, and 138 are disposed along the tablet falling path 131 and mounted to the falling tablet guiding member 131 (see FIGS. 10*b* to 10*d* and 11*a* to 11*c*).

A front surface of the falling tablet guiding member 131 (see FIGS. 10*b* and 10*c*) is inclined by an angle θ from a plumb line such that its upper end is displaced rearward, its lower end is displaced forward, and the left and right side surfaces of the falling tablet guiding member 131 are in parallel with a plumb surface including the plumb line.

The tablet falling path 132 configured to guide the falling tablet 10 is formed at the front surface in six surfaces (the front and rear surfaces, upper and lower surfaces, and the left and right surfaces) of the falling tablet guiding member 131. The front surface is inclined to face obliquely upward (see FIG. 10*d*). The inclination angle θ of the falling tablet guiding member 131 is set to about 15° to 45° (see FIG. 10*c*) such that the tablet 10 slides down in the tablet falling path 131 at a moderate speed without departing from the falling tablet guiding member 131.

The tablet falling path 132 (see FIG. 10*d*) is formed by engraving, pressing, etc. as a groove in the surface of the falling tablet guiding member 131 inclined to face obliquely upward, and continuously extends from the upper end to the lower end of the falling tablet guiding member 131. The slit 135 configured to allow passage of the edges of blades of the cutting mechanism 140 is formed by drilling to penetrate through the falling tablet guiding member 131 at the cutting position 133 set in the middle of the tablet falling path 132. The upstream path 132*a*, which is a portion of the tablet falling path 132 upstream of the cutting position 133, is unbranched. In the embodiment, the upstream path 131*a* is meandering in a crank shape. Therefore, when the tablet 10 slides down the upper half of the upstream path 131*a* above the bent portion, the posture of the tablet 10 is corrected by a groove bottom 132*d* and a right inner wall surface 132*e* of the tablet falling path 132 (see FIG. 11*d*). When the tablet 10 slides down the lower half of the upstream path 131*a* below the bent portion, the posture of the tablet 10 is corrected by the groove bottom 132*d* and a left inner wall surface 132*f* of the tablet falling path 132 (see FIG. 11*e*).

The tablet falling path 132 is branched into two branches at the cutting position 133, more specifically branched into left and right branches at the lower end of the slit 135 provided at the center of the cutting position 133. In a downstream portion of the tablet falling path 132, the left branch path 132*b* and the right branch path 132*c* vertically extend side by side. A left path opening-closing member 134*b* and a right path opening-closing member 134*c* forming the pair of receiving members 134 are disposed to correspond to the left branch path 132*b* and the right branch path 132*c*, respectively. The opening-closing members 134*b* and 134*c* are also turned according to control by the controller 123. The left path opening-closing member 134*b* opens and closes a branch opening from the upstream path 131*a* to the left branch path 132*b*, and the right path opening-closing member 134*c* opens and closes a branch opening from the upstream path 131*a* to the right branch path 132*c*.

Because the tablet splitting apparatus 120 according to the embodiment splits the disk-like tablet 10 into equal left and right halves, the slit 135 is vertically formed at the center of the cutting position 133. The left path opening-closing member 134*b* and the right path opening-closing member 134*c* are bilaterally symmetrically disposed with respect to the slit 135. When the tablet 10 is temporarily held at the cutting position 133, the left path opening-closing member 134*b* and the right path opening-closing member 134*c* (pair of receiving members 134) form a V shape with their lower end portions brought close to each other to close the tablet falling path 131 at a location immediately below the cutting position 133 and the slit 135. When the split tablet pieces 10*b* and 10*c* are guided to the left branch path 132*b* to fall down, the left path opening-closing member 134*b* is turned to communicate the upstream path 131*a* and the left branch path 132*b* with each other. When the split tablet pieces 10*b* and 10*c* are guided to the right branch path 132*c* to fall down, the right path opening-closing member 134*c* is turned to communicate the upstream path 131*a* and the right branch path 132*c* with each other.

The groove depth regulating member 137 (see FIGS. 10*c* and 10*d*) is formed from a thin plate made of a hard transparent resin, for example. In the embodiment, the groove depth regulating member 137 covers substantially the entire area of the tablet falling path 132. However, it is only required that the groove depth regulating member 137 should cover the upstream path 131*a* of the tablet falling path 132 from above and that the groove bottom 132*d* of the upstream path 131*a* and the lower surface, that is, a groove bottom facing surface 137*a*, of the groove depth regulating member 137 should extend in parallel with each other in the covered area. In the example, the groove depth regulating member 137 additionally covers the left branch path 132*b* and the right branch path 132*c* from above while extending in parallel with the groove bottom 132*d*. In the covered area, however, the groove depth regulating member 137 may not extend in parallel but extend such that the clearance between the groove bottom 132*d* and the groove bottom facing surface 137*a* of the groove depth regulating member 137 becomes wider downward, for example, to allow the split tablet pieces 10*b* and 10*c* to smoothly fall down. If it is unlikely that the split tablet pieces 10*b* and 10*c* fly forward out of the branch paths 132*b* and 132*c*, the groove depth regulating member 137 may not cover the branch paths 132*b* and 132*c* from above.

The groove depth regulating member 137 (see FIGS. 11*a* and 11*b*) is driven by the thickness adjusting mechanism 138 mounted to the lower surface of the falling tablet guiding member 131 for example, to be capable of reciprocal motion toward and away from the surface of the falling tablet guiding member 131 inclined to face obliquely upward. The thickness adjusting mechanism 138 changes the separation distance between the groove depth regulating member 137 and the falling tablet guiding member 131 according to control by the controller 123 to change the relative distance C between the groove bottom 132*d* of the tablet falling path 132, in particular the upstream path 131*a*, and the groove bottom facing surface 137*a* of the groove depth regulating member 137.

In addition (see FIG. 11*c*), the width adjusting mechanism 136 is disposed in the upstream path 131*a* of the tablet falling path 131 as with the pair of receiving members 134, the width adjusting mechanism 136 is formed from a movable member having a lower end portion swingable about its upper end portion. The width adjusting mechanism 136 is swung according to control by the controller 123 to variably adjust the groove width D of the upstream path 131*a*. That is, if the width adjusting mechanism 136 is turned toward the left inner wall surface 132*e* of the tablet falling path 132, the width of the tablet falling path 132 is narrowed.

The cutting mechanism 140 (see FIGS. 10 to 12) includes a pair of opposed blades 141 and 142. The pair of opposed blades 141 and 142 move between the movement stand-by position and the movement completion position. The pair of opposed blades 141 and 142 cut the tablet 10 located at the cutting position 133 into equal left and right halves. In the example, the pair of opposed blades 141 and 141 are directed vertically as the holding mechanism 130 is seen from the front. However, the pair of opposed blades 141 and 142 do not extend along a plumb line, but are inclined rearward at the angle θ as with the falling tablet guiding member 131. That is, one opposed blade 141 is located obliquely above, and the other opposed blade 142 is located obliquely below. The one opposed blade 141 is supported obliquely above the slit 135 at the cutting position 133 by a first advancing-retracting member 143 attached to a rigid gate-shaped support mechanism having a rod and a sleeve fitted with each other to perform reciprocal motion. The first advancing-retracting member 143 moves the one opposed blade 141 obliquely downward toward the slit 135 according to control by the controller 123. The other opposed blade 142 is supported by a second advancing-retracting member 145 provided at the back of the falling tablet guiding member 131 to perform reciprocal motion. The second advancing-retracting member 145 moves the other opposed blade 142 obliquely upward toward the tablet 10 at the cutting position 133, while passing through the slit 135, according to control by the controller 123.

The cutting mechanism 140 drives the pair of opposed blades 141 and 141 according to control by the controller 123 to cut the tablet 10 by increasing and reducing the gap between the opposed blades 141 and 142. In this event, the tablet 10 is raised from the groove bottom 132*d* of the tablet falling path 132 before accomplishment of cutting to thereafter accomplish the cutting. In addition (see FIG. 12), the first advancing-retracting member 143 configured to hold the one opposed blade 141 is provided with a first biasing member 144. The second advancing-retracting member 145 configured to hold the other opposed blade 142 is provided with a second biasing member 146. A compression coil spring, for example, is used as each of the first and second biasing members 144 and 146. When the pair of opposed blades 141 and 141 are pushed by an external force toward the retraction side (toward the movement stand-by position), the pair of opposed blades 141 and 141 are retracted within the movable range, such as the expandable-contractible range, of the first and second biasing members 144 and 146. In order to hold and raise the tablet 10 before the tablet 10 is cut, the spring characteristics and the elastic forces of the first and second biasing members 144 and 146 are determined such that their biasing forces toward the advance side during retraction of the pair of opposed blades 141 and 142 become larger than the weight of the tablet 10 at least after a middle of the retraction. However, the spring characteristics and the elastic forces of the first and second biasing members 144 and 146 are determined such that the pair of opposed blades 141 and 141 are strongly advanced at the limit of the movable range.

The controller 123 is a control device formed from a programmable microprocessor system or sequencer, for example, although not shown in detail. The controller 123 controls operation of respective electric motors etc. for the tablet feeder base portion 127, the holding mechanism 130, and the cutting mechanism 140 to establish cooperation among the tablet feeder base portion 127, the holding mechanism 130, and the cutting mechanism 140 such that the tablets 10 are adequately successively fed and cut.

In reducing the gap between the pair of opposed blades 141 and 142 to cut the tablet 10, in particular, the tablet 10 is raised from the groove bottom 132*d* of the tablet falling path 132 before accomplishment of cutting to thereafter accomplish the cutting. This operation will be discussed in detail later by way of several specific examples.

As described in Japanese Patent Application Publication No. 02-95375, there has been developed a tablet identifying apparatus configured to receive the length a, the width b, and the thickness c (a≥b≥c) as data (length information, width information, and thickness information) related to the shape of a tablet to classify the shapes of tablets. The apparatus classifies the shapes from the viewpoint of whether the tablet has a circular shape, an oval shape, a straight portion, or a polygonal shape. Thus, the controller 123 acquires data (length information, width information, and thickness information) related to the shape of the tablet 10 such as the length a, the width b, and the thickness c (a≥b≥c). Means for acquiring such data may obtain the width b and the thickness c in any way, such as by directly receiving them from the operation portion 122, downloading them from an upper-level device (not shown) via an optional communication line or the like, or through a search or a conversion performed based on identification information obtained from the tablet cassette 121. When data on the shape of the tablet 10 are acquired, the controller 123 varies the cross-sectional shape of the upstream path 131*a* of the tablet falling path 132 using the width adjusting mechanism 136 based on the acquired data to regulate the posture of the tablet 10 during a fall and during a passage.

Specifically, when data on the thickness c are acquired, the controller 123 drives the thickness adjusting mechanism 138 based on the thickness c to adapt the relative distance C between the groove bottom 132*d* of the upstream path 131*a* of the tablet falling path 131 and the groove bottom facing surface 137*a* of the groove depth regulating member 137 to the thickness of the tablet 10 by increasing the relative distance C to be slightly larger than the thickness of the tablet 10 (see FIGS. 11*a* and 11*b*). Meanwhile, when data on the width b of the tablet 10 are acquired, the controller 123 turns the width adjusting mechanism 136 based on the data on the width b to adapt the groove width D at the corresponding location of the upstream path 131*a* of the tablet falling path 132 to the width of the tablet 10 by increasing the groove width D to be slightly larger than the width (diameter for a circular tablet) of the tablet 10 (see FIG. 11*c*).

Further, the controller 123 also has a function of switching the mode of discharge of the split tablet pieces formed after the tablet is cut according to the operation mode directly set by operating the operation portion 122 or remotely set through communication etc. Specifically, the controller 123 causes the pair of opposed blades 141 and 142 of the cutting mechanism 140 to cut into the tablet 10 held at the cutting position 133 by the holding mechanism 130 to cut the tablet 10 (see FIG. 13*a*). After that, the controller 123 switches the temporal order of a time at which the pair of opposed blades 141 and 142 are retracted from the cutting position 133 and a time at which the left path opening-closing member 134*b* and the right path opening-closing member 134*c* open the corresponding branch paths. This switching of the temporal order makes it possible to choose whether the split tablet pieces 10*b* and 10*c* of the tablet 10 are caused to fall into different branch paths 132*b* and 132*c* (see FIG. 13*b*) or into the same one of the left branch path 132*b* and the right branch path 132*c* (see FIGS. 13*c* and 13*d*).

The mode of use and operation of the tablet splitting apparatus 120 according to a fifth embodiment will be described with reference to the drawings.

Prior to cutting a tablet 10, the tablet cassette 121 containing a large number of tablets 10 to be cut and split is mounted to the tablet feeder base portion 127, and the receiving container 125 is inserted into the main body portion 124 (see FIGS. 10*a* and 10*b*). As the tablet cassette 121 is mounted, data such as identification information are sent to the controller 123 via the tablet feeder base portion 127. The controller 123 determines based on the data whether or not the type of the cassette is appropriate. In addition, the controller 123 checks whether or not there is any information on the shape of the tablet 10, and if any, automatically acquires the width b and the thickness c of the tablet 10. If such information cannot be automatically acquired, the controller 123 waits for such data to be input via a communication line or from the operation portion 122.

When the controller 123 cannot acquire the thickness c of the tablet 10, the groove depth regulating member 137 is set such that the relative distance C between the groove bottom 132*d* of the tablet falling path 131 and the groove bottom facing surface 137*a* of the groove depth regulating member 137 is slightly larger for a safety margin (see FIG. 11*a*). When the controller 123 acquires data on the thickness c, the position of the groove depth regulating member 137 is automatically adjusted based on the data such that the relative distance C is adapted to the thickness c (see FIG. 11*b*). Similarly, when the controller 123 cannot acquire data on the width b of the tablet 10, the width adjusting mechanism 136 is disposed to extend along the groove sidewall surface (132*f*) of the tablet falling path 132 such that the groove width at the corresponding location of the upstream path 131*a* of the tablet falling path 132 is slightly larger for a safety margin (see FIG. 10*d*). When the controller 123 acquires data on the width b, the swinging position of the width adjusting mechanism 136 is automatically adjusted such that the groove width D at the corresponding location is adapted to the width b (see FIG. 11*c*).

After that, the tablet splitting apparatus 20 can be caused to start a cutting process by operating the operation portion 122. In the initial state, the split tablet piece discharge mode has been set to a separate discharge mode in which the split tablet pieces 10*b* and 10*c* are caused to separately fall into different branch paths 132*b* and 132*c*, respectively (see FIG. 13*b*). Thus, if it is desired to switch the split tablet piece discharge mode to a right discharge mode in which both the split tablet pieces 10*b* and 10*c* are caused to fall into the right branch path 132*c* (see FIGS. 13*c* and 13*d*), or to a left discharge mode in which both the split tablet pieces 10*b* and 10*c* are caused to fall into the left branch path 132*b*, the split tablet piece discharge mode is switched to a desired mode by operating the operation portion 122.

In the initial state, the holding mechanism 130 (see FIG. 10*d*) has closed both the left path opening-closing member 134*b* and the right path opening-closing member 134*c* of the receiving members 134 located immediately below the cutting position 133. No tablet 10 is provided in the holding mechanism 130 and the cutting mechanism 140 to leave the cutting position 133 unoccupied.

In the initial state, further, the cutting mechanism 140 (see FIG. 11*a*) has retracted the one opposed blade 141 outward, or forward and upward, from the cutting position 133 and the other opposed blade 142 inward, or rearward and downward, from the cutting position 133. Thus, the gap between the pair of opposed blades 141 and 142 has been widened.

In this state, when the operation portion 122 is operated to cause the tablet splitting apparatus 120 to start a cutting process, a driving motor of the tablet feeder base portion 127 is driven, and one tablet 10 is dropped and discharged from the tablet cassette 121.

Then, the tablet 10 is put into the tablet falling path 132 of the holding mechanism 130 via an introduction port and a guide of the tablet feeder base portion 127. The tablet 10 is first guided by the upstream path 131*a* of the tablet falling path 132 to the cutting position 133.

Displacement of the falling tablet 10 in the thickness direction is restricted by the relative distance C between the groove bottom 132*d* of the tablet falling path 131 and the groove bottom facing surface 137*a* of the groove depth regulating member 137 determined to be adapted to the thickness c of the tablet 10 (see FIG. 11*b*). In addition, displacement of the falling tablet 10 in the width direction is restricted by the groove width D of the tablet falling path 131 at the location of installation of the width adjusting mechanism 136 determined to be adapted to the width b of the tablet 10 (see FIG. 11*c*). Furthermore, the posture of the tablet 10 is corrected by the groove bottom 132*d* and the right inner wall surface 132*e* of the tablet falling path 132 in the most upstream region of the upstream path 131*a* (see FIG. 11*d*), and by the groove bottom 132*d* and the left inner wall surface 132*f* of the tablet falling path 132 in the midstream region of the upstream path 131*a* (see FIG. 11*e*), as the upstream path 131*a* of the tablet falling path 132 meanders to vary its inclination direction.

Therefore, each and every tablet 10 that has reached the cutting position 133 past the stand-by member 139 (see FIG. 10*d*) which opens at suitable timings has taken the same posture.

The tablet 10 which has reached the cutting position 133 contacts the pair of receiving members 134 to be stopped. That is, the tablet 10 is positioned at the center between the two receiving members 134, that is, the left path opening-closing member 134*b* and the right path opening-closing member 134*c*, to be held to face the slit 135 (see FIG. 13*a*). At this time, the tablet 10 is held in the holding mechanism 130 by the groove bottom 132*d* of the tablet falling path 132 of the falling tablet guiding member 131 and portions of the two receiving members 134 in contact with the tablet 10, and located in the gap between the pair of opposed blades 141 and 142 without contacting the pair of opposed blades 141 and 142 (see FIGS. 12*b* and 13*a*).

From that state, the tablet 10 is cut by the cutting mechanism 140. There are a plurality of cutting modes that can be chosen in advance by operating the operation portion 121 among these, three modes will be discussed in detail.

First, if a first cutting mode is chosen, the other opposed blade 142 is slightly advanced toward the one opposed blade 141. When the tablet 10 is pushed by the other opposed blade 142 to be slightly raised to be departed from the groove bottom 132*d* of the tablet falling path 132, the other opposed blade 142 is stopped. Next, the one opposed blade 141 is advanced toward the other opposed blade 142. When the gap between the pair of opposed blades 141 and 142 is reduced and the tablet 10 is caught between the pair of opposed blades 141 and 142, the one opposed blade 141 is stopped (see FIG. 12*c*). Thereafter, the receiving members 134 are turned open to be spaced apart from the tablet 10. At this time, the tablet 10 has been held by the pair of opposed blades 141 and 142 and thus does not fall which is undesirable.

From that state, driving of the cutting mechanism 140 is resumed. While the biasing force of the first biasing member 144 to advance the one opposed blade 141 and the biasing force of the second biasing member 146 to advance the other opposed blade 142 are not enough to cause the pair of opposed blades 141 and 142 to cut into the tablet 10, the springs of the first and second biasing members 144 and 146 are compressed while increasing their biasing forces. Therefore, the pair of opposed blades 141 and 142 continuously hold the tablet 10 (see FIG. 12*d*). Then, when the biasing forces of the first and second biasing members 144 and 146

Figure 12A:
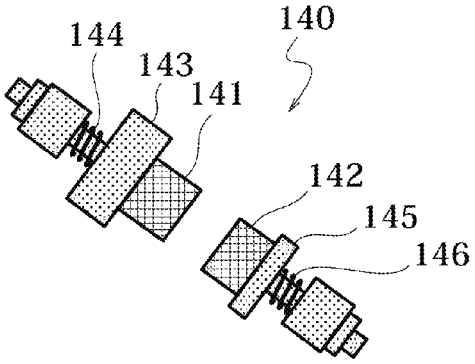
FIGS. 12*a* to 12*f* are each a right side view of an essential portion of the cutting mechanism.
Figure 12B:
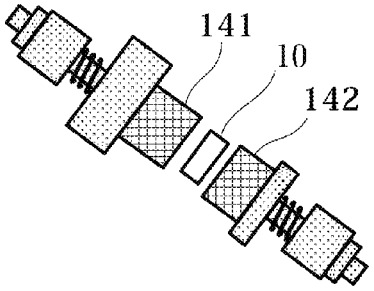
Figure 12C:
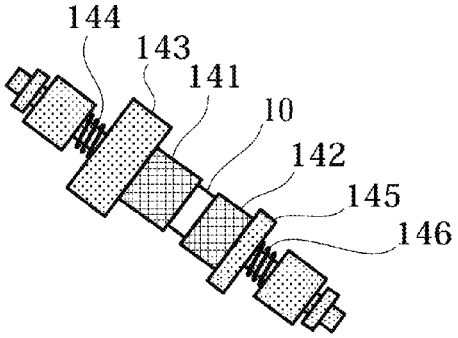
Figure 12D:
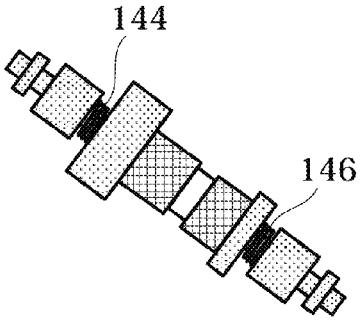
Figure 12E:
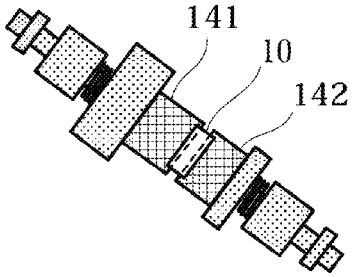
Figure 12F:
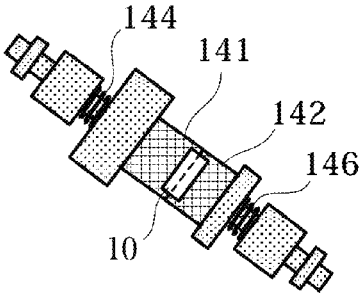

(forces for propelling the pair of opposed blades 141 and 142) are sufficiently increased, the pair of opposed blades 141 and 142 start cutting into both the plan and bottom surfaces of the tablet 10 (see FIG. 12*e*). After that, the first and second biasing members 144 and 146 elastically expand to cause the pair of opposed blades 141 and 142 to rapidly cut to the inside of the tablet 10 (see FIG. 12*f*), resulting in the tablet 10 being finely cut to be split into two split tablet pieces 10*b* and 10*c*.

If a second cutting mode is chosen, in contrast, the pair of opposed blades 141 and 142 which have been spaced apart from each other are advanced at substantially the same time to reduce the gap therebetween. Along with this motion, the one opposed blade 141 reaches the plan surface of the tablet 10 approximately when the other opposed blade 142 pushes the bottom surface of the tablet 10 to slightly raise the tablet 10 from the groove bottom 132*d* of the tablet falling path 131 and the tablet 10 is held by the pair of opposed blades 141 and 142. The subsequent process is the same as that in the first cutting mode discussed above, and thus will not be described in detail. In the second cutting mode, driving of the cutting mechanism 140 is not temporarily stopped, and thus the cutting operation is quickly performed. In addition, fluctuations in weight of the split tablet pieces may be further reduced by making the spring sensitivity of the second biasing member 146 lower than that of the first biasing member 144 to make the elastic forces produced by the first and second biasing members 144 and 146 uneven.

If a third cutting mode is chosen, meanwhile, the one opposed blade 141, of the pair of opposed blades 141 and 142 which have been spaced apart from each other, is first advanced. When the edge of the one opposed blade 141 reaches the plan surface of the tablet 10, the advance driving of the one opposed blade 141 is stopped. Consequently, the tablet 10 is lightly pressed against the groove bottom 132*d* of the tablet falling path 132 by the biasing force of the first biasing member 144 to correct the posture of the tablet 10. Next, the other opposed blade 142 is driven to be advanced, and thus the gap between the pair of opposed blades 141 and 142 is reduced. When the other opposed blade 142 reaches the bottom surface of the tablet 10, the tablet 10 is held by the pair of opposed blades 141 and 142. Further, the other opposed blade 142 is continuously driven to be advanced to compress the springs of the first and second biasing members 144 and 146. As a result, the other opposed blade 142 is advanced and the one opposed blade 141 is retracted because of the balance between the biasing forces of the springs of the first and second biasing members 144 and 146 to raise the tablet 10 from the groove bottom 132*d* of the tablet falling path 132. The subsequent process is generally similar to that in the first and second cutting modes discussed above, and thus will not be described in detail. In the third cutting mode, the cutting operation is quickly and adequately performed by alternately driving the one opposed blade 141 and the other opposed blade 142.

Then, when the tablet 10 is split into a split tablet piece 10*b* produced on the left side of the pair of opposed blades 141 and 142 and a split tablet piece 10*c* produced on the right side of the pair of opposed blades 141 and 142 (see FIG. 13*a*), the split tablet pieces 10*b* and 10*c* are dropped and discharged by opening the opening-closing members 134*b* and 134*c* according to the split tablet piece discharge mode being set.

Specifically, if the split tablet piece discharge mode is the separate discharge mode, the opening-closing members 134*b* and 134*c* are opened before the pair of opposed blades 141 and 142 are retracted (see FIG. 13*b*) to cause the left split tablet piece 10*b* to be dropped and discharged from the left branch path 132*b* to be received in the left receiving container 125*b*, and to cause the right split tablet piece 10*c* to be dropped and discharged from the right branch path 132*c* to be received in the right receiving container 125*c*.

Figure 13A:
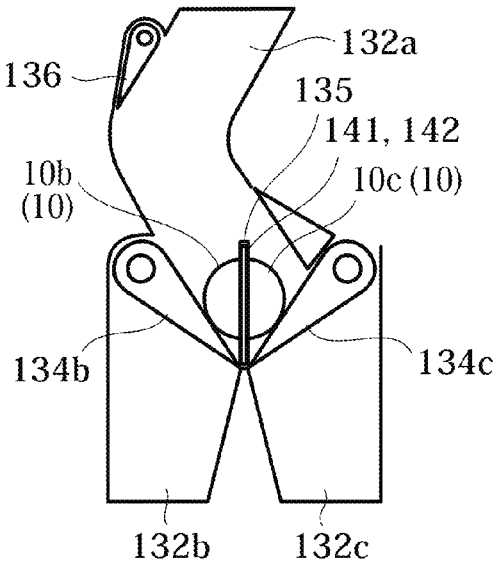
FIGS. 13*a* to 13*d* are each a plan view of an essential portion of the holding mechanism.
Figure 13B:
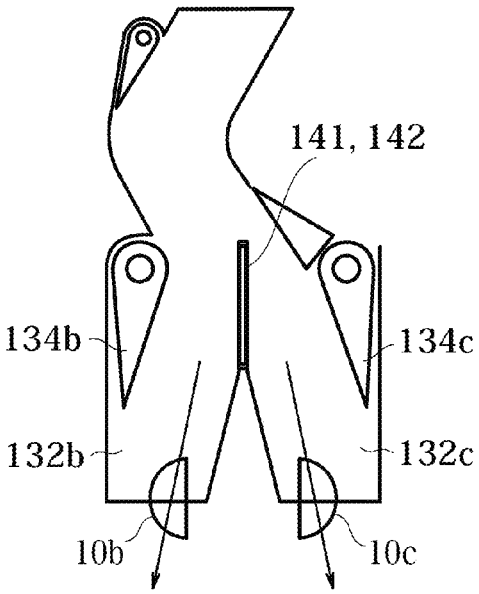
Figure 13C:
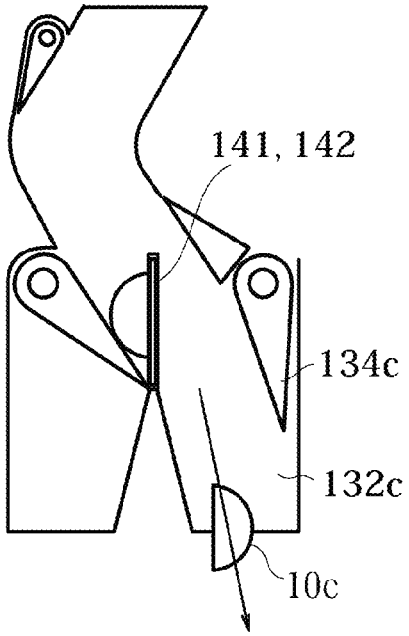
Figure 13D:
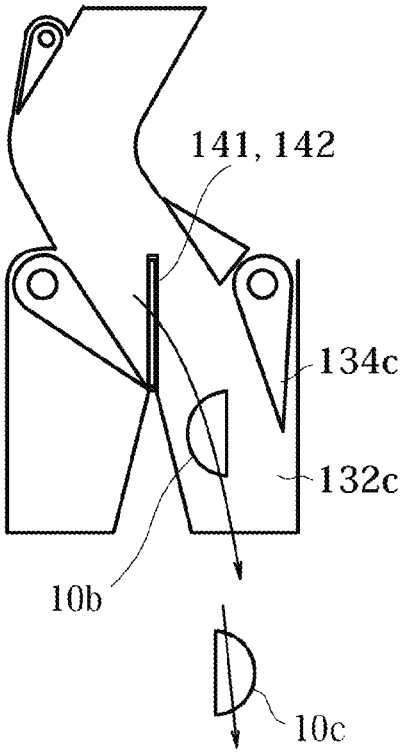
Figure 14A:
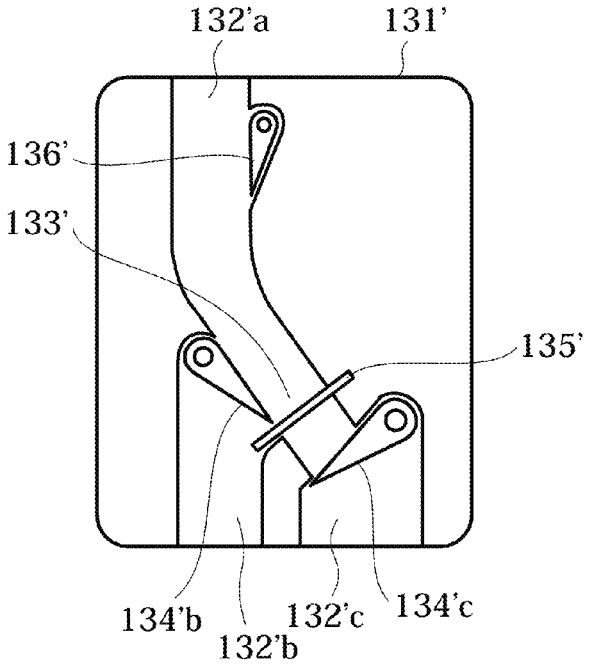
FIGS. 14*a* to 14*d* are each a plan view of an essential portion of a holding mechanism.
Figure 14B:
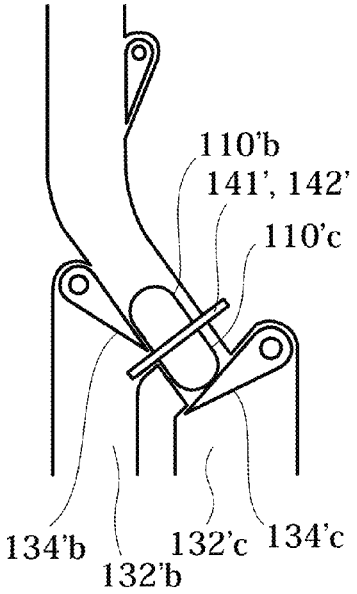
Figure 14C:
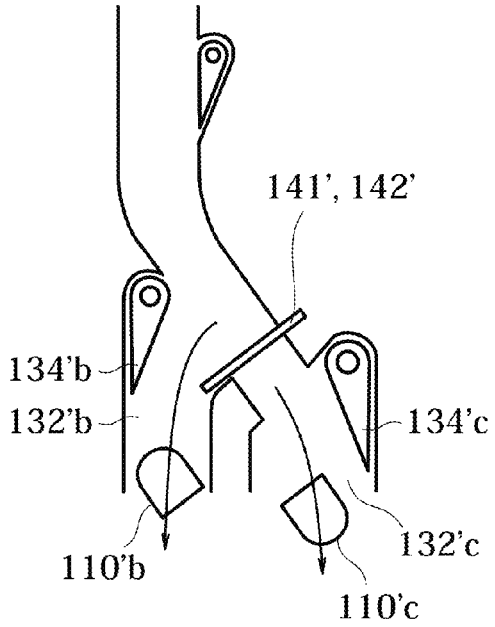
Figure 14D:
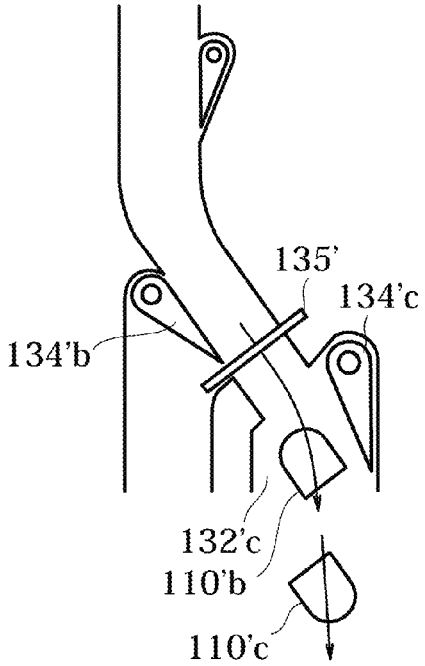

If the split tablet piece discharge mode is the right discharge mode, in contrast, the right path opening-closing member 134*c* is opened with the left path opening-closing member 134*b* closed and the pair of opposed blades 141 and 142 stopped to first cause the right split tablet piece 10*c* to be dropped and discharged from the right branch path 132*c* (see FIG. 13*c*). Thereafter, the pair of opposed blades 141 and 142 are retracted with the left path opening-closing member 134 kept closed to cause the remaining left split tablet piece 10*b* to be dropped and discharged from the right branch path 132*c* (see FIG. 13*d*). Thus, both the split tablet pieces 10*b* and 10*c* are received in the right receiving container 125*c*.

Further, if the split tablet piece discharge mode is the left discharge mode, although not shown, the left path opening-closing member 134*b* is opened with the right path opening-closing member 134*c* closed and the pair of opposed blades 141 and 142 stopped to first cause the left split tablet piece 10*b* to be dropped and discharged from the left branch path 132*b*. Thereafter, the pair of opposed blades 141 and 142 are retracted with the right path opening-closing member 134*c* kept closed to cause the remaining right split tablet piece 10*c* to be dropped and discharged from the left branch path 132*b*. Both the split tablet pieces 10*b* and 10*c* are received in the left receiving container 125*b*.

In this way, the left and right split tablet pieces 10*b* and 10*c* are distributed to the left and right branch paths 132*b* and/or 132*c* according to the split tablet piece discharge mode, passed through the relay portion 126, and thereafter received in the corresponding receiving containers 125*a* and/or 125*b*.

Then, in the meantime, the receiving members 134 are turned closed, both of the opposed blades 141 and 142 in the pair are retracted, and the holding mechanism 130 and the cutting mechanism 140 are returned to the initial state. If it is necessary to cut further tablets 10, the operation discussed above is repeated.

[Sixth Embodiment]

A specific configuration of a tablet splitting apparatus according to a sixth embodiment of the present invention will be described with reference to the drawings. FIGS. 14*a* to 14*d* are each a front view of an essential portion of a holding mechanism 130' used in the sixth embodiment. The tablet splitting apparatus (see FIG. 14*a*) differs from the tablet splitting apparatus 120 according to the fifth embodiment discussed above in that the L-shaped crank of an upstream path 132'*a* of a tablet falling path 132' has a larger bend angle, that a branch opening for a left branch path 132'*b* and a left path opening-closing member 134'*b* have been relocated to the upstream side, that the direction of a slit 135' has been changed to perpendicularly intersecting the upstream path 132'*a*, and that the direction of a pair of opposed blades 141' and 142' has also been changed as with the slit 135' although not shown. Such differences make the tablet splitting apparatus according to the embodiment suitable to split an elongated columnar or rectangular tablet 110' in the longitudinal direction into two pieces.

In the embodiment, the tablet 110' slides down the upstream path 132'*a* with the longitudinal direction of the tablet 110' matching the direction of the path. When the tablet 110' reaches a cutting position 133', the tablet 110' is stopped by receiving members 134', and thereafter cut 15-16 by the pair of opposed blades 141' and 142' into an upper left split tablet piece 110'*b* and a lower right split tablet piece 110'*c* (see FIG. 14*b*).

Then (see FIG. 14*c*), if the split tablet piece discharge mode is the separate discharge mode, the opening-closing members 134'*b* and 134'*c* are opened before the pair of opposed blades 141' and 142' are retracted. The upper left split tablet piece 110'*b* is dropped and discharged from the left branch path 132'*b* to be received in a left receiving container 125'*b*, and the lower right split tablet piece 110'*c* is dropped and discharged from the right branch path 132'*c* to be received in a right receiving container 125'*c*.

If the split tablet piece discharge mode is the right discharge mode, in contrast (see FIG. 14*d*), the right path opening-closing member 134'*c* is opened with the left path opening-closing member 134'*b* closed and the pair of opposed blades 141' and 142' stopped to first cause the lower right split tablet piece 110'*c* to be dropped and discharged from the right branch path 132'*c*. After that, the pair of opposed blades 141' and 142' are retracted with the left path opening-closing member 134'*b* kept closed to cause the remaining upper left split tablet piece 110'*b* to be dropped and discharged from the right branch path 132'*c*. As a result, both the split tablet pieces 110'*b* and 110'*c* are received in the right receiving container 125*c*.

Although the left discharge mode is not supported in FIG. 14, the left discharge mode may also be implemented in the same manner.

In the fifth and sixth embodiments described above, the cutting mechanism 140, 140' cuts the tablet 10, 110' by advancing and retracting the edges of the pair of opposed blades. However, a rotary blade may be used for cutting.

In the fifth and sixth embodiments described above, in addition, the split tablet piece discharge mode is kept as initially chosen. However, the split tablet piece discharge mode may be switched at suitable timings. For example, the discharge mode may be switched or reset each time one tablet 10, 110' is cut.

In the fifth and sixth embodiments described above, further, the tablet 10, 110' is split into two equal halves. However, the tablet 10, 110' may be split into uneven pieces. For uneven splitting, the separate discharge mode is particularly convenient.

The operation portion 122 is not essential, and a sequence of cutting operations may be started in response to the tablet 10, 110' reaching the cutting position 133, 133', for example. Indication of the operating state may be present or absent. The stand-by member 139 may be or may not be provided. The receiving container 125 and the relay portion 126 are also not essential if the split tablet pieces are discharged without trouble. If automatic successive feeding of the tablets is not necessary, the tablet feeder base portion 127 and the tablet cassette 121 are also not essential. Further, it is not essential that the driving members for the pair of opposed blades 141 and 142 (141' and 142') and driving members for the pair of receiving members 134, 134' should be expressly defined as being electrically driven, fluidly driven, etc. Such driving members may be incorporated into a power transmission portion of the holding mechanism or the cutting mechanism, or the like. For example, the opposed blades 141 and 142 (141' and 142') and the receiving members 134, 134' may be driven by an operation of pressing or rotating a manual handle.

[Seventh Embodiment]

Figure 15:
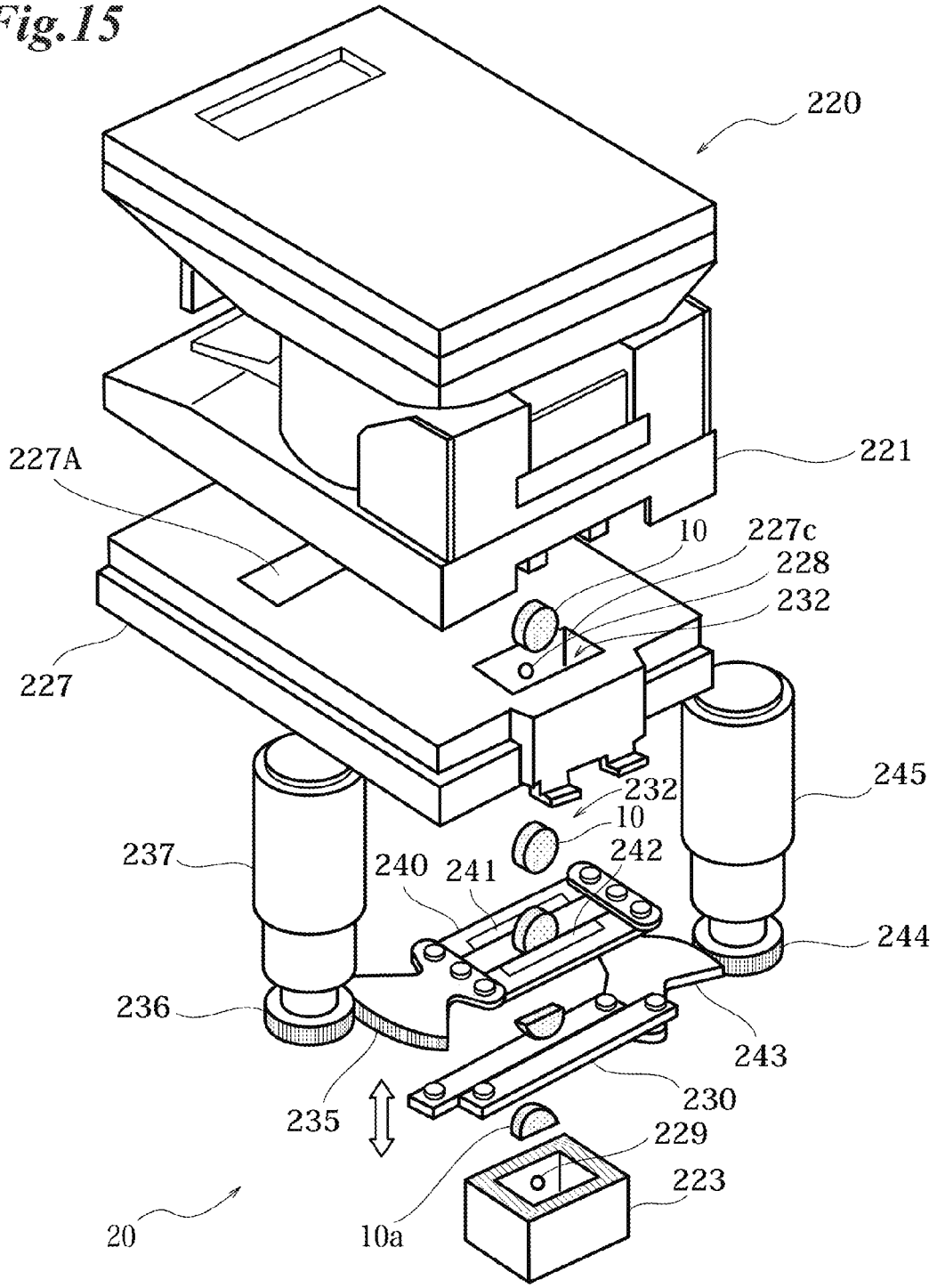
FIG. 15 shows the structure of a tablet splitting apparatus according to a seventh embodiment of the present invention, showing a developed perspective view of an essential mechanism.
Figure 16A:
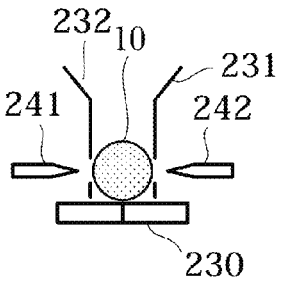
FIGS. 16*a* to 16*c* are each a simplified front view showing the vicinity of a tablet passage.
Figure 16B:
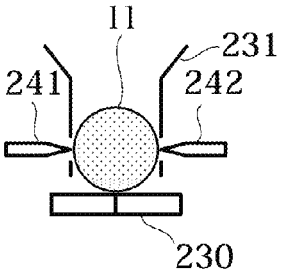
Figure 16C:
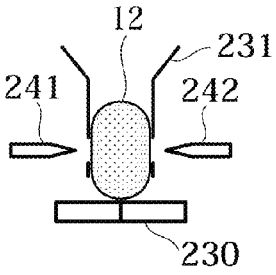

A specific configuration of a tablet splitting apparatus according to a seventh embodiment of the present invention will be described with reference to the drawings. FIG. 15 is a developed perspective view of an essential mechanism of a tablet splitting apparatus 220, in which a housing, support members, etc. are not shown. FIGS. 16*a* to 16*c* are each a simplified front view of a falling tablet guiding member 231 forming a tablet passage and a pair of opposed blades 241 and 242 provided to face the falling tablet guiding member 231 and a holding mechanism 230.

The tablet splitting apparatus 220 (see FIG. 15) includes a tablet feeder base portion 227 to which a tablet cassette 221 is removably mounted, the falling tablet guiding member 231 configured to surround a part of a tablet passage 232 together with a tablet introduction portion 227*c* of the tablet feeder base portion 227, a cutting mechanism 240 configured to cut a tablet 10 into upper and lower pieces, the holding mechanism 230 provided below the cutting mechanism 240 to retain the tablet 10 to be cut at the cutting mechanism 240, and an elevating mechanism 244 configured to move the holding mechanism 230 in the vertical direction. The tablet cassette 221 is replaceable at suitable timings, and it is only required that the tablet cassette 221 should be mounted to the tablet feeder base portion 227 to be able to discharge the tablets 10 one by one. Cassette identification information is affixed to the bottom surface of the tablet cassette 221 by barcode printing, for example (see Japanese Unexamined Patent Application Publication No. 2005-192702).

The tablet feeder base portion 227 is described in detail in Japanese Patent Application Publication No. 11-226088, Japanese Unexamined Patent Application Publication No. 11-226089, Japanese Patent Application Publication No. 2005-192701 and so forth. The tablet feeder base portion 227 is provided with a gear and a motor configured to drive the tablet cassette 221 for discharge, an identification information reading portion 227A formed from a barcode reader, for example, to read cassette identification information on the tablet cassette 221 and a tablet introduction portion 227*c* configured to surround the leading portion of the tablet falling path. A through hole into which the tablet 10 discharged from the tablet cassette 221 is put is formed in the tablet introduction portion 227*c*. The tablet introduction portion 227*c* is provided with a tablet detecting member 228 configured to detect the tablet 10 dropped from the tablet cassette 221 to pass through the tablet introduction portion 227*c*.

The cutting mechanism 240 (see FIG. 15) mainly includes a four-bar parallel link disposed in the middle of the tablet falling path, and two opposed blades 241 and 241 are separately provided on the two long opposite sides of the four-bar parallel link. The opposed blades 241 and 241 are each a straight blade, and are arranged in parallel with each other with their edges facing each other. A driven gear 235 is provided to one of the short sides of the four-bar parallel link of the cutting mechanism 240. A driving gear 236 is fixed to a rotary shaft of an electric motor 237 to mesh with the driven gear 235. The electric motor 237 is a servomotor or a stepping motor capable of reciprocal rotational motion. When the electric motor 237 is rotated in one direction, the four-bar parallel link is opened into a rectangular arrangement to open the tablet falling path 232. When the electric motor 237 is rotated in the other direction, the four-bar parallel link is closed into a single plate arrangement to block the tablet falling path 232. In accompaniment with this operation, the pair of opposed blades 241 and 242 move between the movement stand-by position and the movement completion position. When cutting is not performed, the pair of opposed blades 241 and 242 are spaced apart from each other at the movement stand-by position. When cutting is performed, the pair of opposed blades 241 and 242 are brought closer into contact with each other at the movement completion position.

The holding mechanism 230 (see FIG. 15) also mainly includes a four-bar parallel link disposed in the middle of the tablet falling path 231 as with the cutting mechanism 240, but is not provided with a pair of opposed blades 241 and 242 driven gear 243 is provided to one of the short sides of the four-bar parallel link of the holding mechanism 230. A driving gear 244 is fixed to an electric motor 245 to mesh with the driven gear 243. The electric motor 245 is a servomotor or a stepping motor capable of reciprocal rotational motion. When the electric motor 245 is rotated in one direction, the four-bar parallel link is opened into a rectangular arrangement to open the tablet falling path 232. When the electric motor 245 is rotated in the other direction, the four-bar parallel link is closed into a single plate arrangement to block the tablet falling path 232. When cutting is not performed, the holding mechanism 230 is closed to receive the tablet 10. When the tablet 10, half tablets 10*a* which are split tablet pieces, etc. are dropped and discharged, the holding mechanism 230 is opened.

The falling tablet guiding member 231 (only the lower end portion of which is shown in FIG. 15; see FIG. 16 for the entirety thereof) is structured such that the width or the diameter of the tablet falling path 232 can be increased and reduced. For example, the entire falling tablet guiding member 231, or at least a portion of the falling tablet guiding member 231 in the vicinity of the cutting mechanism 240, may be formed from two split guide members separately disposed on the left and right sides. The width or the diameter of the tablet falling path 232 is increased and reduced by varying the relative distance between the two split guide members. Any distance changing mechanism may be used to vary the relative distance between the two split guide members. Tablet position adjusting section for appropriately adjusting the retaining position or the cutting position of various tablets of different shapes with respect to the pair of opposed blades 241 and 242 is embodied by causing the distance changing mechanism and the elevating mechanism 244 discussed above to cooperate with each other according to control by a control device. Specifically, the retaining position (cutting position) of the tablet is automatically adjusted by adjusting the width of the tablet falling path 232 of the falling tablet guiding member 231 and vertically moving the holding mechanism 230 based on medicine information on the tablet to be cut.

For example, for a small round tablet 10 (see FIG. 16*a*), the falling tablet guiding member 231 narrows the width of the tablet falling path 231 and elevates the holding mechanism 230. For a large round tablet 11 (see FIG. 16*b*), the falling tablet guiding member 231 widens the width of the tablet falling path 231 and lowers the holding mechanism 230. For an elongated round tablet 12 (see FIG. 16*c*), the falling tablet guiding member 231 narrows the width of the tablet falling path 231 and lowers the holding mechanism 230. Whatever tablet may be retained by the holding mechanism 230, the posture of the tablet is stabilized in the tablet falling path 232 surrounded by the falling tablet guiding member 231 and an intended location of the tablet to be cut is positioned between the pair of opposed blades 241 and 242.

The mode of use and operation of the tablet splitting apparatus 220 according to the seventh embodiment will be described with reference to the drawings. FIGS. 17*a* to 17*e* are each a diagram schematically showing the relationship between the falling tablet guiding member 231 surrounding the tablet falling path 231 and the pair of opposed blades 241 and 242 provided to face the falling tablet guiding member 231, the holding mechanism 230, and the tablet detecting members 228 and 229. FIGS. 18*a* to 18*d* are each a plan view of the cutting mechanism 240.

When the apparatus is started immediately after the tablet splitting apparatus 220 is turned on, or when the tablet cassette 221 is mounted to the tablet feeder base portion 227 of the tablet splitting apparatus 220, cassette identification information on the bottom surface of the tablet cassette 221 is read by the identification information reading portion 227A of the tablet feeder base portion 227. Medicine information is acquired from the read cassette identification information by a search through a database of the control device etc. For those tablet cassettes 221 which may be mounted to the tablet splitting apparatus 220, among a large number of tablet cassettes 221 containing various medicines, cassette identification information on such tablet cassettes 221 and medicine information on the medicines contained therein have been set in advance in the database. Consequently, information necessary to appropriately cut the tablet 10 to be cut, in particular shape information, can be obtained by accessing the database.

The tablet falling path 232 of the falling tablet guiding member 231 is widened and narrowed and the holding mechanism 230 is vertically moved based on the medicine information to perform automatic adjustment according to the tablet to be cut. At this time, the pair of opposed blades 241 and 242 of the cutting mechanism 240 are opened and the holding mechanism 230 is closed, as it normally is, in preparation for cutting the tablet (see FIG. 17*a*). In this state, when the tablet 10 is discharged from the tablet cassette 221, the fall of the tablet 10 is detected by the tablet detecting member 228. When a predetermined time further elapses, the tablet 10 which has further fallen down is received by the holding mechanism 230 to be held at the cutting position. At this time, the tablet 10 is retained between the pair of opposed blades 241 and 242 (see FIG. 17*b*). If the tablet 10 is to be split into two equal halves, the cutting position is determined such that the center of the tablet 10 is located between the pair of opposed blades 241 and 242.

Figure 17A:
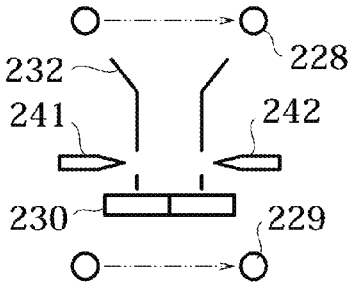
FIGS. 17*a* to 17*e* are each a simplified front view showing the vicinity of the tablet passage.
Figure 17B:
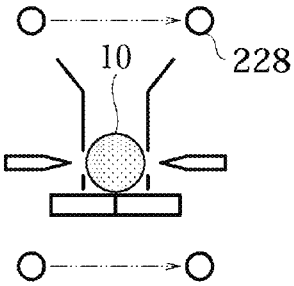
Figure 17C:
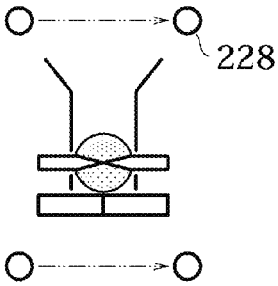
Figure 17D:
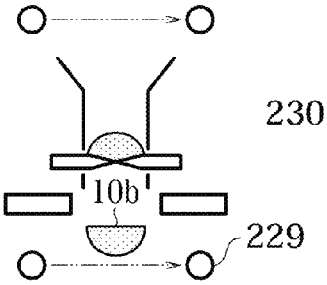
Figure 17E:
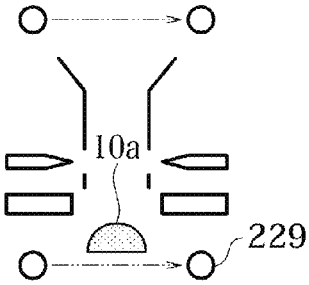

Thereafter, the edges of the pair of opposed blades 241 and 242 of the cutting mechanism 240 are brought closer into contact with each other to split the tablet 10 into upper and lower pieces (see FIG. 17*c*). From that state, first, the holding mechanism 230 is opened to cause the half tablet 10*b*, which is the lower split tablet piece, to fall down (see FIG. 17*d*). Next, the pair of opposed blades 241 and 242 are also opened to cause the half tablet 10*a*, which is the upper split tablet piece, to fall down. In this way, the tablets 10 to be cut are fed one by one to the cutting mechanism 240 to be cut by the pair of opposed blades 241 and 242 and the split tablet pieces are individually dropped and discharged. If both the cutting mechanism 240 and the holding mechanism 230 are open, the tablet 10 simply passes by to fall down. Thus, the tablet 10 can be discharged as it is without being cut.

Figure 18A:
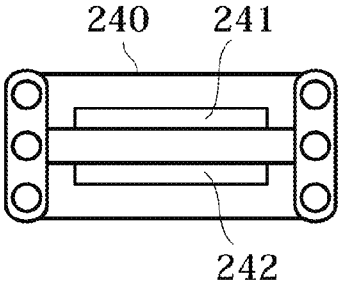
FIGS. 18*a* to 18*d* are each a plan view of a cutting mechanism.
Figure 18B:
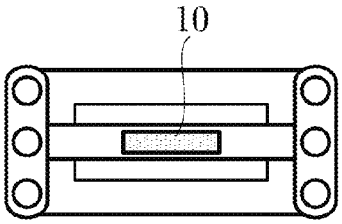
Figure 18C:
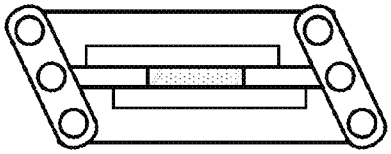
Figure 18D:
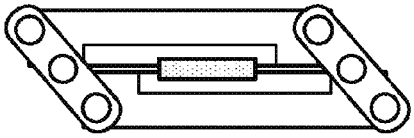

If the four-bar parallel link is in the rectangular arrangement and the pair of opposed blades 241 and 242 are open (see FIG. 18*a*) when the tablet 10 is to be cut by the cutting mechanism 240, the tablet 10 falls between the pair of opposed blades 241 and 242 in preparation for being cut (see FIG. 18*b*). After that, the four-bar parallel link is deformed into a parallelogram arrangement to reduce the gap between the pair of opposed blades 241 and 242 (see FIG. 18C). When the edges of the pair of opposed blades 241 and 242 contact each other, the tablet 10 is completely cut (see FIG. 18*d*). In this event, the pair of opposed blades 241 and 242 are relatively displaced in the parallel direction, and thus the tablet 10 is cut into from the front and back sides while pulling the pair of opposed blades 241 and 242 in the opposite directions, allowing the tablet 10 to be finely cut.

[Eighth Embodiment]

Figure 19A:
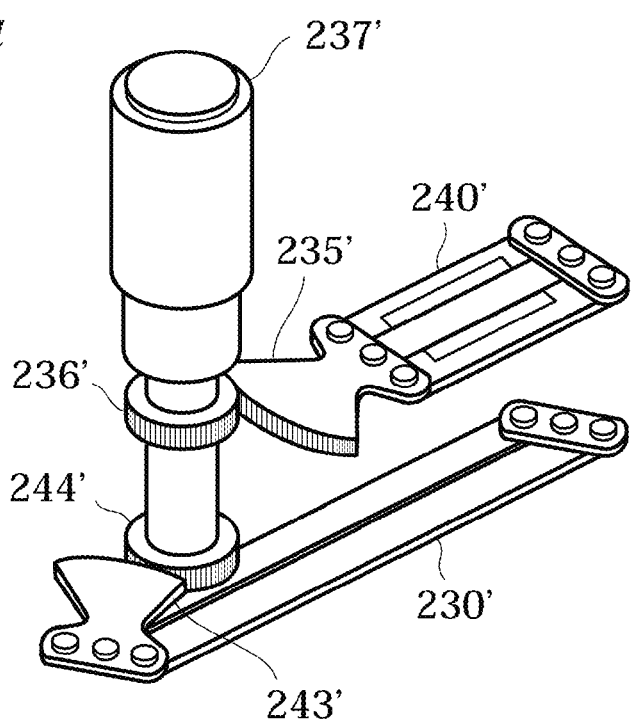
FIGS. 19*a* and 19*b* are each a perspective view of a cutting mechanism and a receiving mechanism.
Figure 19B:
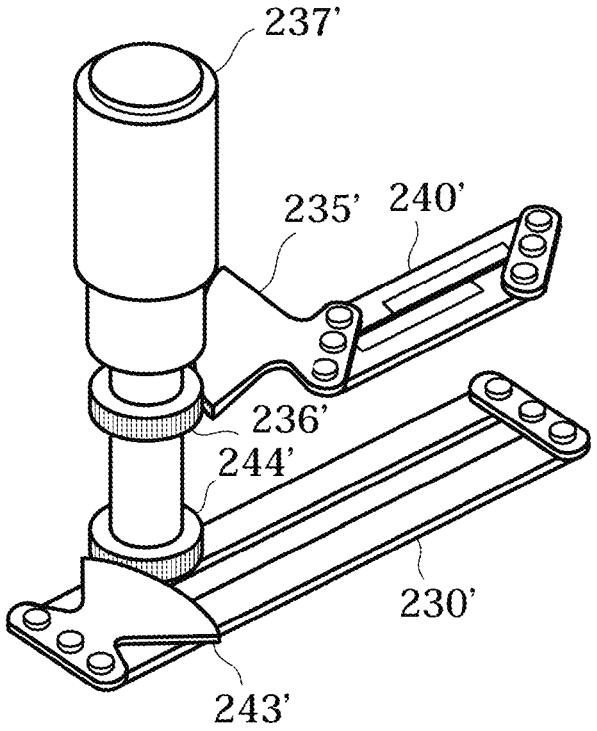

FIGS. 19*a* and 19*b* show the configuration of an essential portion of an eighth embodiment. The embodiment differs from the seventh embodiment in that a driving gear 244' is driven by an electric motor 237' together with a driving gear 236'. Consequently, the electric motor 245 (FIG. 15) can be dispensed with, and the mechanism is accordingly simplified. In the embodiment, a holding mechanism 230' is closed as a cutting mechanism 240' is opened (see FIG. 19*a*), and the holding mechanism 230' is opened as the cutting mechanism 240' is closed (see FIG. 19*b*).

In this case, when a tablet to be cut is to be received, the cutting mechanism 240' is opened and the holding mechanism 230' is closed (see FIG. 19*a*), and the tablet is retained at a cutting position by the holding mechanism 230'. When the tablet is to be cut, the cutting mechanism 240' is closed and the holding mechanism 230' is opened (see FIG. 19*b*). The tablet is split into upper and lower pieces by the closing operation of the cutting mechanism 240'. Then, the lower half tablet falls down, but the upper half tablet stays on the cutting mechanism 240'. Then, when the cutting mechanism 240 is opened and closed and the holding mechanism 230' is closed and opened again, the upper half tablet also falls down.

In this way, also in this case, the tablet is split into upper and lower pieces, and the split tablet pieces are individually discharged.

[Ninth Embodiment]

Figure 20A:
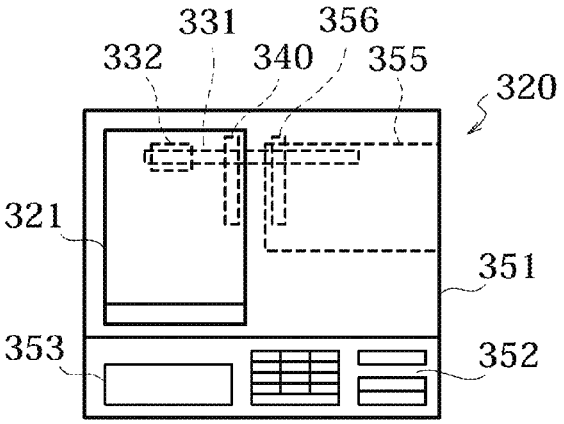
FIG. 20*a* is a plan view.
Figure 20C:
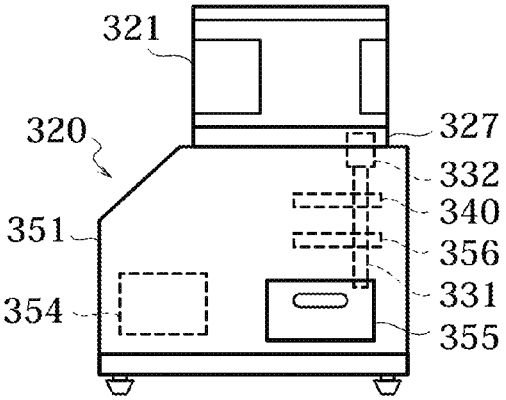
FIG. 20*c* is a right side view.
Figure 20B:
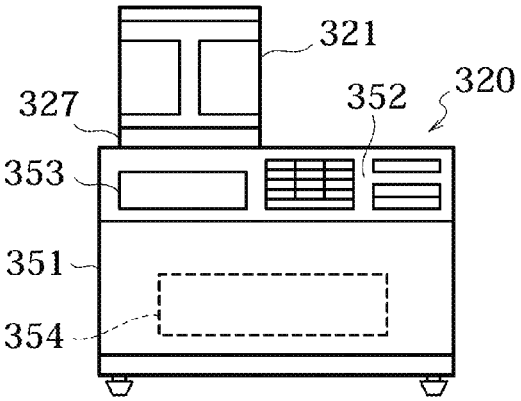
FIG. 20*b* is a front view.
Figure 20D:
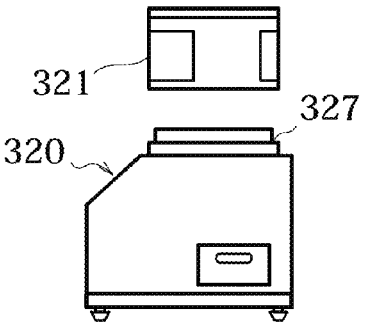
FIG. 20*d* is a right side view with a tablet cassette removed.
Figure 21A:
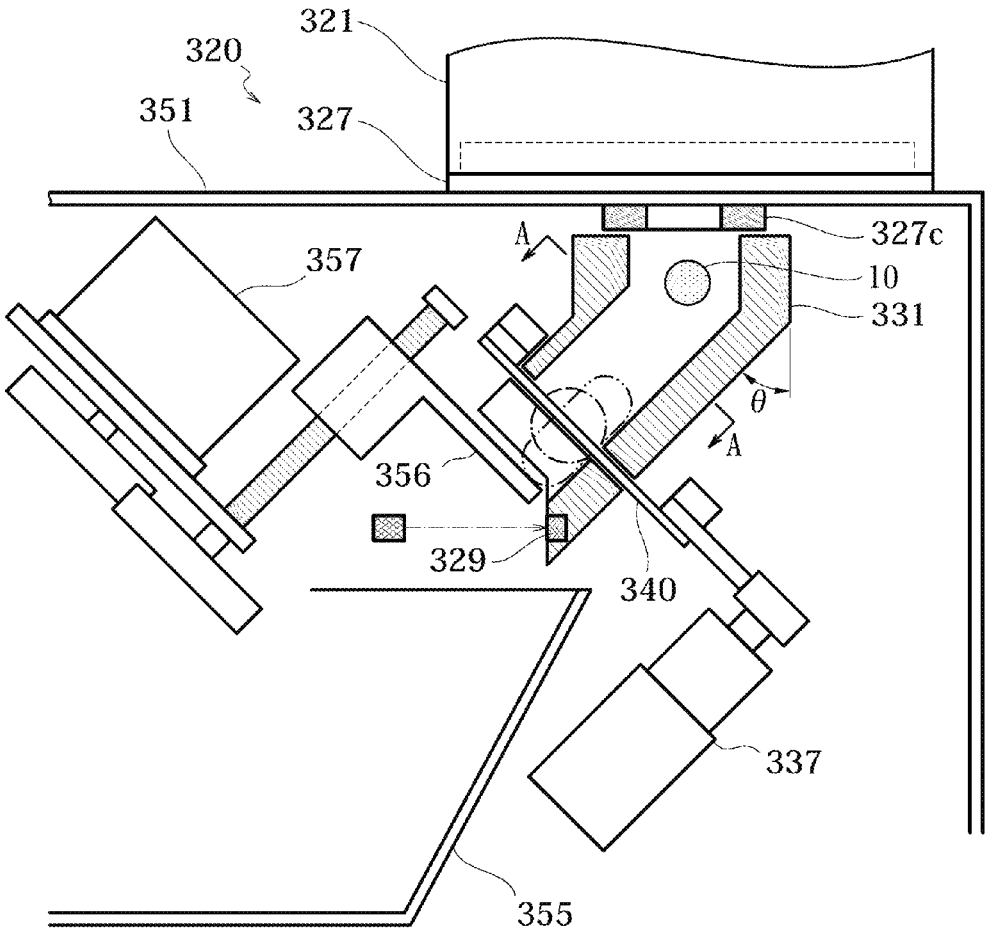
FIG. 21*a* is a rear view of an essential mechanism partially shown in section.
Figure 21B:
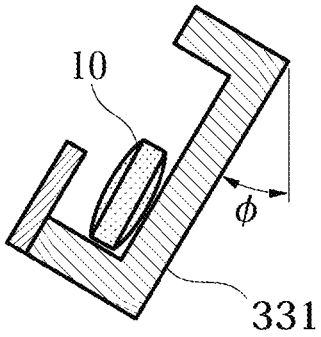
FIG. 21*b* is a cross-sectional view of a tablet guiding member taken along the line A-A.
Figure 22A:
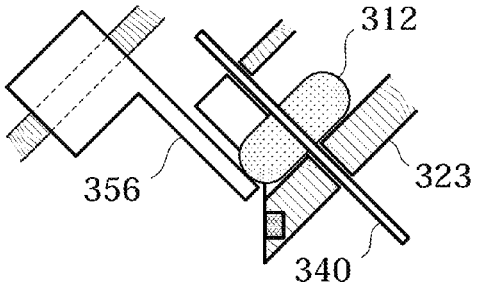
FIGS. 22*a* to 22*d* are each a rear view showing the vicinity of a tablet passage partially shown in section.
Figure 22B:
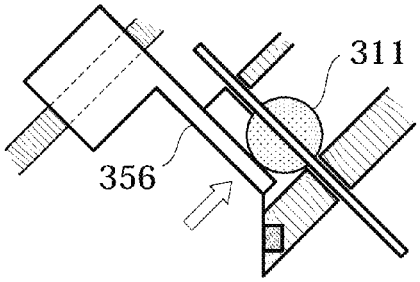
Figure 22C:
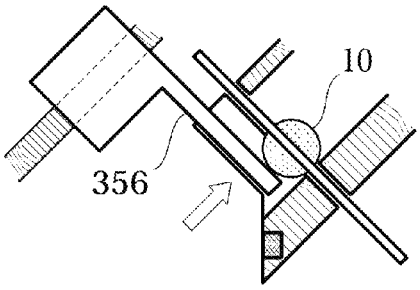
Figure 22D:
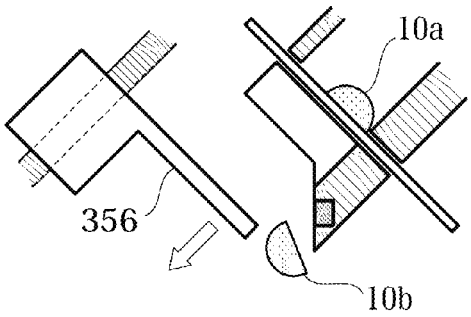

A specific configuration of a tablet splitting apparatus according to a ninth embodiment of the present invention will be described with reference to the drawings. FIGS. 20*a* to 20*c* show the overall appearance of a tablet splitting apparatus 320 to which a tablet cassette 321 is mounted, in which FIG. 20*a* is a plan view, FIG. 20*b* is a front view, and FIG. 20*c* is a right side view. FIG. 20*d* is a right side view of the tablet splitting apparatus 320 with the tablet cassette 321 removed. Further, FIG. 21*a* is a rear view of an essential mechanism partially shown in section, and FIG. 21*b* is a cross-sectional view of a falling tablet guiding member 331 taken along the line A-A. FIGS. 21*a* to 22*d* are each a rear view showing the vicinity of a tablet falling path partially shown in section.

In order to be easily used as an independent dedicated tabletop unit, the tablet splitting apparatus 320 (see FIG. 20) is compactly mounted in a small housing 351 including a display 353 and an operation portion 352 provided on the upper front inclined surface. A tablet feeder base portion 327 is mounted to the upper surface of the housing 351*a* cutting mechanism 340 and the falling tablet guiding member 331 are built in the housing 351 at a location obliquely below the tablet feeder base portion 327. A half tablet receiving box 355 is drawably inserted below the cutting mechanism 340 and the falling tablet guiding member 331, a control device 354, a power source, etc. are also built in the housing 351.

Those components described above which were not mentioned in relation to the seventh and eighth embodiments discussed above do not necessarily constitute differences from such embodiments, but merely have not been described so far.

The tablet splitting apparatus 320 mainly differs from the tablet splitting apparatus 220 according to the seventh embodiment discussed above in that a receiving member 356 and an electric motor 357 have been introduced in place of the holding mechanism 230 and the electric motor 245, that the falling tablet guiding member 331 is not widened or narrowed, that the falling tablet guiding member 331 does not extend along a plumb line but is inclined, and that the cutting mechanism 340 and the receiving member 356 are also inclined at the same inclination angle as that of the falling tablet guiding member 331.

A major portion of the falling tablet guiding member 331 forming the tablet falling path, excluding a portion immediately below a tablet introduction portion 327*c*, is generally inclined at approximately an angle θ from a plumb line (see FIG. 21*a*), and also inclined at approximately an angle ϕ from a plumb line in cross section of the falling tablet guiding member 331 (see FIG. 21*b*). The inclination angle θ is relatively large enough for the tablet 10 to roll down or slide down on the lower inner surface of the falling tablet guiding member 331 and set to 45°, for example. The inclination angle ϕ is smaller than the inclination angle θ to allow the tablet 10 to lightly lean on the lower surface of the falling tablet guiding member 331, and set to 15°, for example. The falling tablet guiding member 331 inclined in this way contacts and supports the falling tablet with its two lower sides, even if the falling tablet guiding member 331 is formed as a simple member that is not widened or narrowed. Thus, the posture of various tablets of different shapes and sizes can be stabilized while the tablet is guided to fall down.

The receiving member 356 is formed as a simple single plate that is not deformed to open and close (see FIG. 21*a*), and driven by the electric motor 357 to move only vertically with respect to a tablet falling path surrounded by the falling tablet guiding member 331. When an elongated round tablet 312 is to be retained at the cutting mechanism 340, the receiving member 356 is positioned in the vicinity of the lower end of the falling tablet guiding member 331 (see FIG. 22*a*). For a large round tablet 311, the receiving member 356 is moved slightly closer to the cutting mechanism 340 (see FIG. 22*b*). For a small round tablet 10, the receiving member 356 is brought closest to the cutting mechanism 340 (see FIG. 22*c*).

The operation of adjusting the tablet retaining position is similar to that discussed above. When the half tablets 10*a* and 10*b* formed by cutting the tablet 10 or the tablet 10 to be passed without being cut is caused to fall into the half tablet receiving box 355, however, the receiving member 356 is significantly lowered (see FIG. 22*d*) unlike what has been discussed above. That is, when the receiving member 356 is lowered to increase the gap between the receiving member 356 and the falling tablet guiding member 331 and the space ahead of the lower end of the falling tablet guiding member 331 is sufficiently opened, the tablet 10 or the split tablet pieces 10*a* and 10*b* are passed through the space to fall down.

In this case, the falling tablet guiding member 331 is a fixed member and operation of the receiving member 356 is the only operation, which reduces or simplifies the mechanism and the motor to drive such components. Also in this case, however, the tablet is split into upper and lower pieces and the split tablet pieces are individually discharged without a hitch.

[Tenth Embodiment]

Figure 23:
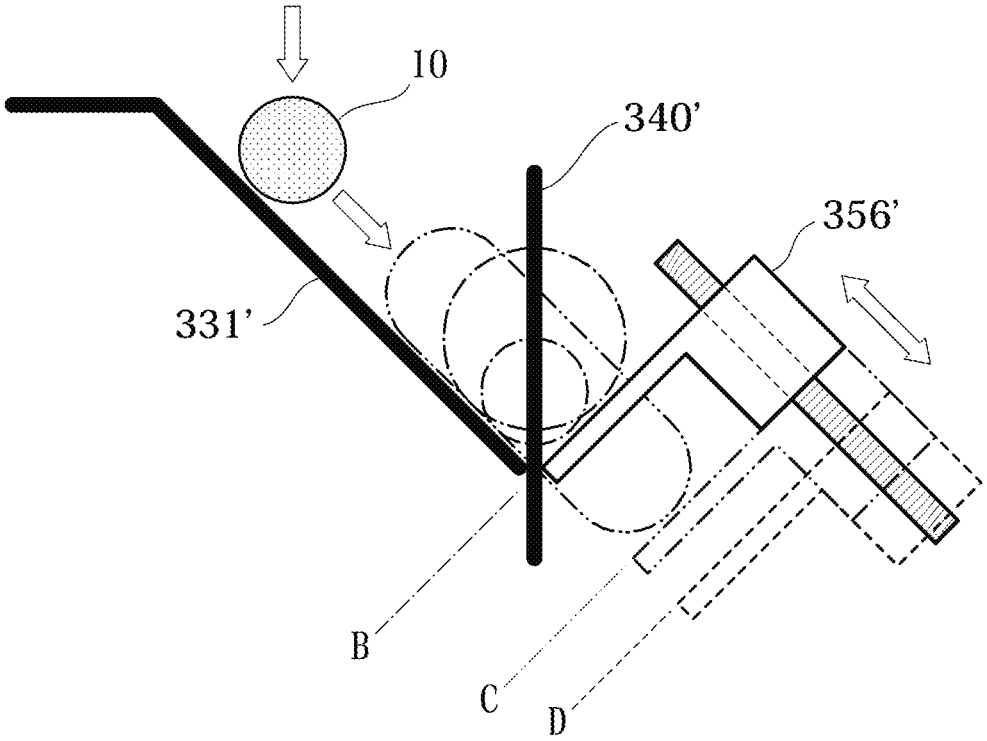
FIG. 23 shows the structure of a tablet splitting apparatus according to a tenth embodiment of the present invention, showing a simplified elevational view of an essential mechanism.

FIG. 23 shows a schematic elevational view of an essential mechanism of a tenth embodiment. A tablet splitting apparatus according to the tenth embodiment differs from that according to the ninth embodiment discussed above in that a cutting mechanism 340' is interposed between a falling tablet guiding member 331' and a receiving member 356', and that the cutting mechanism 340' is directed to bisect the angle between the inclination direction of the falling tablet guiding member 331' and the inclination direction of the receiving member 356'. In the specific example shown, the cutting mechanism 340' extends along a plumb line, the falling tablet guiding member 331' is inclined counterclockwise at approximately 45° from a plumb line, and the receiving member 356' is inclined clockwise at approximately 45° from a plumb line.

In this case, if the receiving member 356' is located at a line-symmetric position B at which the receiving member 356' is line-symmetric to the falling tablet guiding member 331' with reference to the cutting mechanism 340', round tablets of a circular or spherical shape are split into two equal halves irrespective of their diameter. When a tablet of other shapes, e.g. an elongated round shape, is to be cut, the receiving member 356' is moved to a suitable position C according to the shape indicated by medicine information on the tablet. Further, when a tablet or split tablet pieces are caused to fall down, the receiving member 356' is significantly moved to a position D at which the receiving member 356' is spaced apart from the cutting mechanism 340' and the lower end of the falling tablet guiding member 331' enough to allow the tablet to pass by. Therefore, also in this case, the tablet is split into upper and lower pieces and the split tablet pieces are individually discharged without a hitch.

In the seventh and eighth embodiments described above, medicine information is retrieved based on cassette identification information read by the identification information reading portion 227A to grasp the shape of a tablet. However, information on the shape of tablets or the number of tablets to be processed may be input by operating the operation portion 351 and the input information may be visually checked on the display 353. Alternatively, the falling tablet guiding member 231 or the like may be provided with a length measuring device formed from a line CCD, for example, and the holding mechanism 230 and the receiving member 356 may be moved according to the length measuring results. This eliminates the need for a database for medicine information, reducing the work of initial setting and updating data.

[Eleventh Embodiment]

Figure 24:
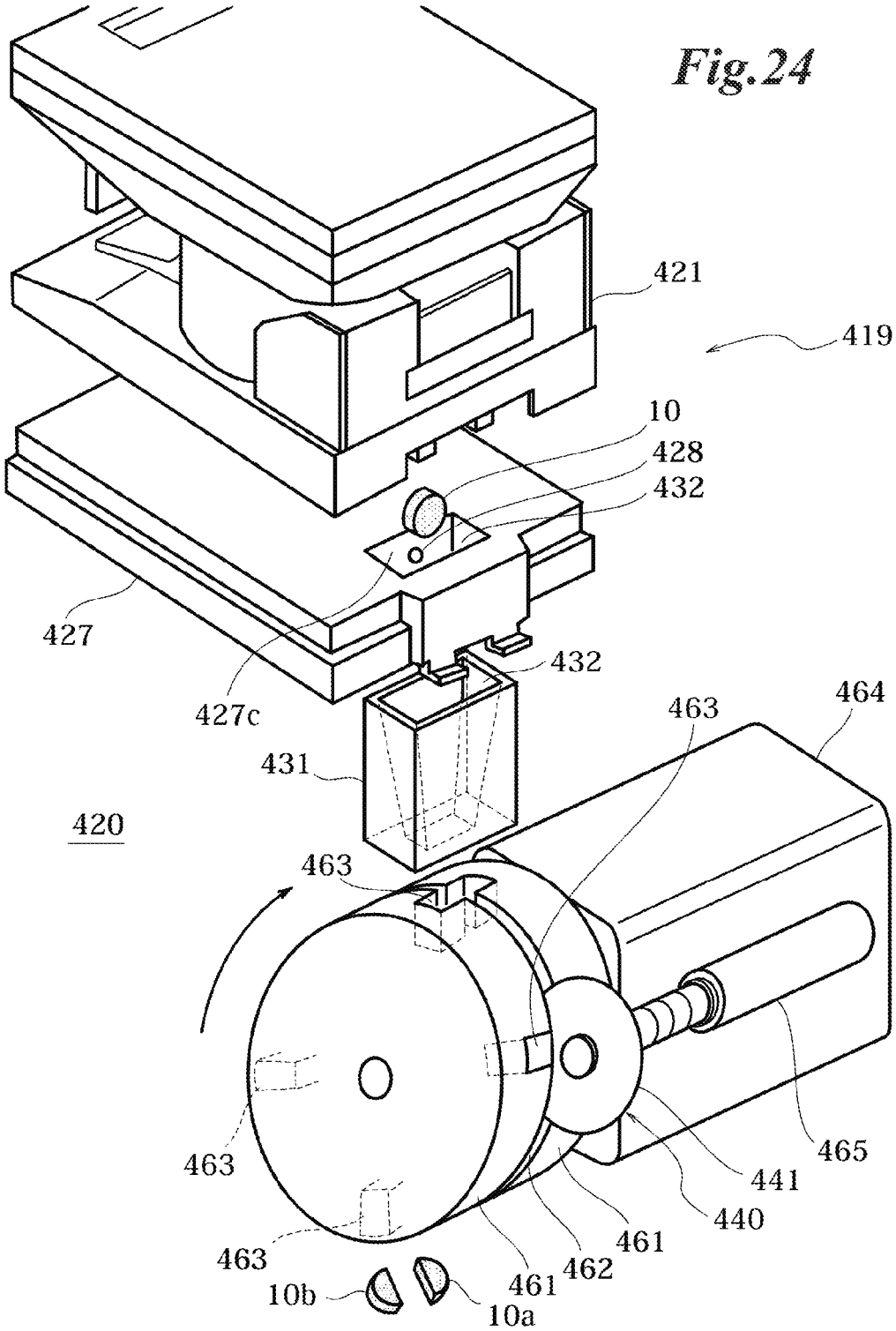
FIG. 24 is a perspective view showing the structure of an essential portion of a tablet splitting apparatus according to an eleventh embodiment of the present invention.

A disk-like rotary blade configured to cut into a tablet while rotating may be used as a cutting device. FIG. 24 is a perspective view of an essential portion of a tablet splitting apparatus 420 with a rotary blade. The tablet splitting apparatus 420 includes a falling tablet guiding member 431, a sequential tablet feeding portion 419, a cutting mechanism 440, and a control device and a support member (not shown). The sequential tablet feeding portion 419 may be of a type known in the art as long as tablets 10 to be split can be dropped and discharged one by one. For example, sequential tablet feeding portions known in the art described in Japanese Patent Application Publication No. 11-226088 and Japanese Patent Application Publication No. 11-226089 may be used. The sequential tablet feeding portion 419 includes a tablet cassette 421 removably mounted to be replaceable, for example, and a tablet feeder base portion 427 to which the tablet cassette 421 is removably mounted. The tablet feeder base portion 427 is provided with a gear and a motor configured to drive the mounted tablet cassette 421 for discharge. A through hole into which the tablet 10 discharged from the tablet cassette 421 is put is formed in the tablet introduction portion 427*c* of the tablet feeder base portion 427. The tablet introduction portion 427*c* is provided with a tablet detecting member 428 configured to detect the tablet 10 falling down through the tablet introduction portion 427*c*.

The falling tablet guiding member 431 forms a portion of a tablet falling path 432 for the tablets 10 before being cut that feeds the falling tablets 10 which have been fed one by one from the sequential tablet feeding portion 419 to the cutting mechanism 440. In order to only resolve the different in height between the sequential tablet feeding portion 419 and the cutting mechanism 440, the falling tablet guiding member 431 may be a vertically mounted cylindrical member such as that shown. In order to cope with lateral displacement etc., however, the falling tablet guiding member 431 may be a duct, a shoot, etc. installed obliquely, be appropriately bent, or be provided with an open-close shutter etc. for passage timing adjustment.

The cutting mechanism 440 includes a thin disk-like rotary blade 441 formed from a commercially available round diamond cutter with a shaft, for example, an electric motor 447 for rotational drive configured to support the rotary blade 441 with a rotary shaft to rotate the shaft, and tablet transfer mechanisms 461 to 464 configured to feed the tablet 10 to the rotary blade 441. In the example, the electric motor 447 and the rotary blade 441 are installed in such a posture that the rotary shaft horizontally extends, and thus the rotary blade 441 vertically cuts the tablet 10.

The tablet transfer mechanisms 461 to 464 include a drum-shaped rotatable member 461 disposed in the tablet falling path 432 extending from a location immediately below the falling tablet guiding member 431 to the rotary blade 441 and an electric motor 464 for rotational drive configured to support the rotatable member 461 with a rotary shaft to rotate the shaft. The electric motor 464 and the rotatable member 461 are also installed in such a posture that the rotary shaft horizontally extends to match the direction of the rotary blade 441.

The rotatable member 461 is fabricated from a single short cylindrical member by engraving, for example. An annular groove 462 into which the rotary blade 441 can be loosely inserted is formed in the outer peripheral portion of the rotatable member 461. In addition, a plurality of bottomed holes 463 are formed in the outer peripheral portion of the rotatable member 461 at locations overlapping the groove 462. The groove 461 and the plurality of bottomed holes 463 communicate with each other. The number of the bottomed holes 463 may be singular or plural. For each bottomed hole 463, the shape of the opening portion is substantially rectangular, and a pair of long sides perpendicularly intersect the groove 461 and extend over an equal distance on both sides of the groove 462. The bottomed holes 463 are each engraved from the rectangular opening portion. The depth of the bottomed holes 463 is close to the diameter of the tablet 10. The short sides of the bottomed holes 463 are slightly longer than the thickness of the tablet 10. The long sides of the bottomed holes 463 discussed earlier are slightly longer than the diameter of the tablet 10. Thus, when the bottomed hole 463 is located right below the falling tablet guiding member 431, the bottomed hole 463 can receive the tablet 10 dropped from the falling tablet guiding member 431 further, the depth of the groove 462 is slightly larger than the depth of the bottomed hole 463 so that the rotary blade 441 can reach the bottom of the bottomed hole 463 when the bottomed hole 463 is located at the rotary blade 441.

In addition, a fitting hole into which a rotary shaft can be fitted is formed in the axial portion of the rotatable member 461. The rotary shaft of the electric motor 464 is fitted into the fitting hole to be able to transmit rotation. When the electric motor 464 is driven to rotate the rotatable member 461, the bottomed hole 463 circulates through a tablet receiving position immediately below the falling tablet guiding member 431 at which the opening portion of the bottomed hole 463 is directed upward, a tablet cutting position at which the rotary blade 441 is partially accommodated in the groove 461 and a tablet discharge position at which the opening portion of the bottomed hole 463 is directed downward or obliquely downward.

The control device (not shown) drives the sequential tablet feeding portion 419 to discharge the tablet 10, and detects a fall of the tablet 10 with the tablet detecting member 428. Then, the control device intermittently puts the tablets 10 one by one into the falling tablet guiding member 431 and waits for a lapse of time required for the falling tablet 10 to enter the bottomed hole 463. Thereafter, the control device drives the electric motor 447 to rotate the rotary blade 441 and drives the electric motor 464 to rotate the rotatable member 461.

The mode of use and operation of the tablet splitting apparatus 420 according to the embodiment will be described. Although not shown, the typical mode of use of the tablet splitting apparatus 420 is that the tablet splitting apparatus 420 is operated as incorporated in a tablet storage or a tablet collecting mechanism of a tablet dispensing device as in the related art. In that case, the control device may be embodied by a lower-level device configured to receive a split command from a control device for the tablet dispensing device, or may be embodied by some of programs installed in the control device for the tablet dispensing device etc. Then, when the tablet splitting apparatus 420 cuts the tablet 10 with the rotary blade 441 to split the tablet 10 into two half tablets 10*a* and 10*b* (a plurality of split tablet pieces), the tablet splitting apparatus 420 operates according to control by the control device as follows.

One tablet 10 is discharged from the tablet cassette 421 to be put into the tablet introduction portion 427*c*. After the tablet detecting member 428 detects a fall of the tablet 10, the tablet 10 which has further fallen down is guided by the falling tablet guiding member 431 to the rotatable member 461 any of the bottomed holes 463 of the rotatable member 461 has come to be located immediately below the falling tablet guiding member 431 to be directed upward during a period since the tablet detecting member 428 detects a fall of the tablet 10 until the tablet 10 is guided to the rotatable member 461 as a result, the falling tablet 10 is inserted into the bottomed hole 463 directed upward. In this event, the tablet 10 is vertically directed by the falling tablet guiding member 431 to be received in the bottomed hole 463 while the tablet 10 is still in the vertical posture. Because play for the tablet 10 in the bottomed hole 463 is marginal, the tablet 10 is stably held in the bottomed hole 463.

Thereafter, the rotatable member 461 is rotated to feed the tablet 10 to the rotary blade 441 together with the bottomed hole 463. Since the bottomed hole 463 is disposed to extend over an equal distance on both sides of the groove 462, the tablet 10 is split into two equal halves by the rotary blade 441 inserted into and rotating in the groove 462 to obtain two half tablets 10*a* and 10*b*. When the rotatable member 461 is further rotated to cause the bottomed hole 463 to be directed downward, the half tablets 10*a* and 10*b* fall down out of the bottomed hole 463. If only one tablet 10 is to be split, rotation of the rotatable member 461 is stopped when an unoccupied bottomed hole 463 has come to a location immediately below the falling tablet guiding member 431 in preparation for next splitting. If a plurality or a large number of tablets 10 are to be split, the tablets 10 are dropped one by one each time an unoccupied bottomed hole 463 comes to a location immediately below the falling tablet guiding member 431, improving the processing efficiency.

[Twelfth Embodiment]

Figure 25A:
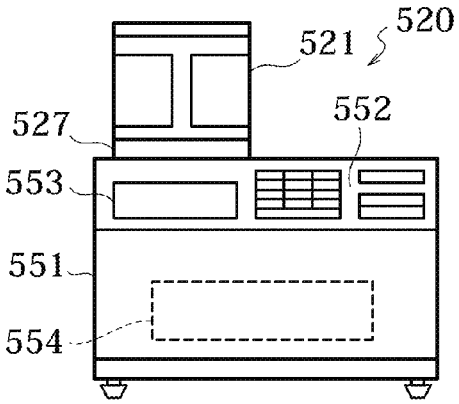
FIG. 25*a* is a front view.
Figure 25B:
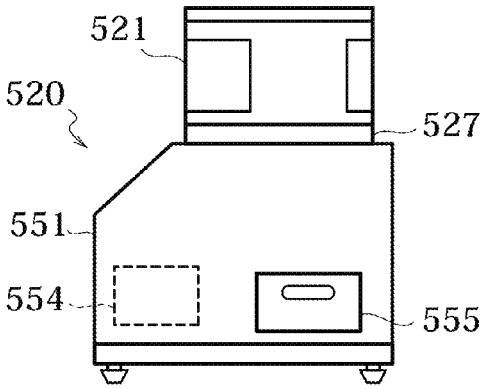
FIG. 25*b* is a right side view.
Figure 25C:
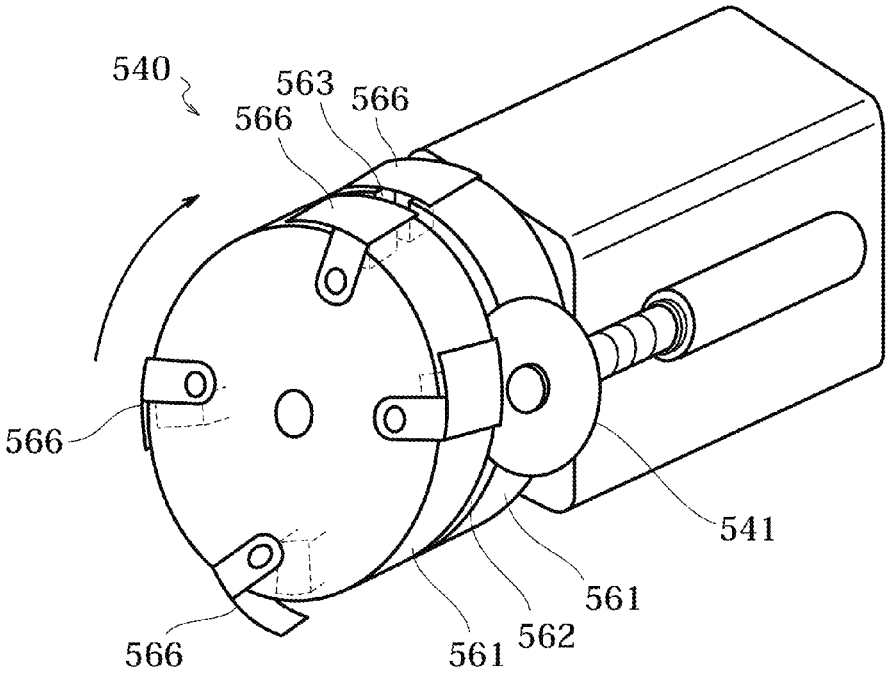
FIG. 25*c* is a perspective view of a cutting mechanism.

A specific configuration of a tablet splitting apparatus according to a twelfth embodiment of the present invention will be described with reference to the drawings. FIG. 25*a* is a front view of a tablet splitting apparatus 520, FIG. 25*b* is a right side view of the tablet splitting apparatus 520, and FIG. 25*c* is a perspective view of a cutting mechanism 540.

The tablet splitting apparatus 520 differs from the tablet splitting apparatus 420 according to the eleventh embodiment discussed above in being a dedicated unit independent of a tablet dispensing device, and in that the cutting mechanism 440 has been modified to form the cutting mechanism 540.

In order to be easily used as an independent dedicated tabletop unit, the tablet splitting apparatus 520 (see FIGS. 25*a* and 25*b*) is compactly mounted in a small housing 551 including a display 551 and an operation portion 553 provided on the upper front inclined surface. A tablet feeder base portion 527 to which a tablet cassette 521 is removably mounted is mounted to the upper surface of the housing 551, a falling tablet guiding member and a cutting mechanism 540 are built in the housing 551 at a location below or obliquely below the tablet feeder base portion 527. A half tablet receiving box 555 is drawably inserted below the falling tablet guiding member and the cutting mechanism 540. A control device 554, a power source, etc. are also built in the housing 551.

The cutting mechanism 540 differs from the cutting mechanism 440 shown in FIG. 24 in that each of bottomed holes 563 in the outer peripheral portion of a rotatable member 561 is provided with two movable lids 566. The movable lids 566 are swung to open and close an opening of the bottomed hole 563. The two movable lids 566 are disposed on both sides of a groove 562, rather than on the groove 562, not to interfere with a rotary blade 541. The movable lids 566 are swung in accompaniment with rotation of the rotatable member 561. For example, at the tablet receiving position at which the tablet 10 is received in the bottomed hole 563, the movable lids 566 are swung by interference with a suitable temporary engagement member (not shown) to an open side to open the bottomed hole 563. At the rotary blade 541, that is, at the tablet cutting position, meanwhile, the movable lids 566 are swung because of their own weight to a closed side to close the bottomed hole 563. At the tablet discharge position at which the half tablets 10*a* and 10*b* are discharged from the bottomed hole 563, the movable lids 566 are swung because of their own weight to the open side.

In this case, a major portion of the opening of the bottomed hole 563 containing the tablet 10 to be cut is blocked by the movable lids 566 when the tablet 10 is cut by the rotary blade 541. Therefore, undesirable events such as rattle of the tablet 10, scattering of dust, etc. are caused only at a reduced frequency or to a reduced degree.

[Thirteenth Embodiment]

Figure 26A:
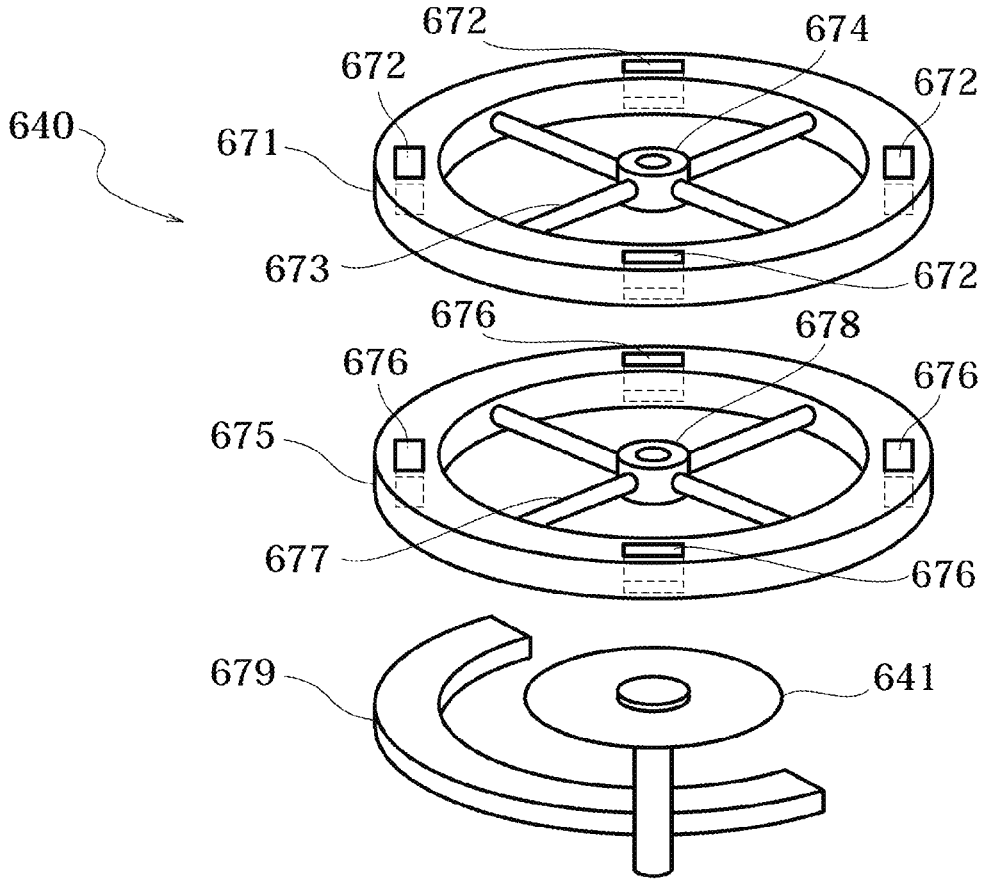
FIG. 26*a* is a developed view and FIG. 26*b* is a perspective view.
Figure 26B:
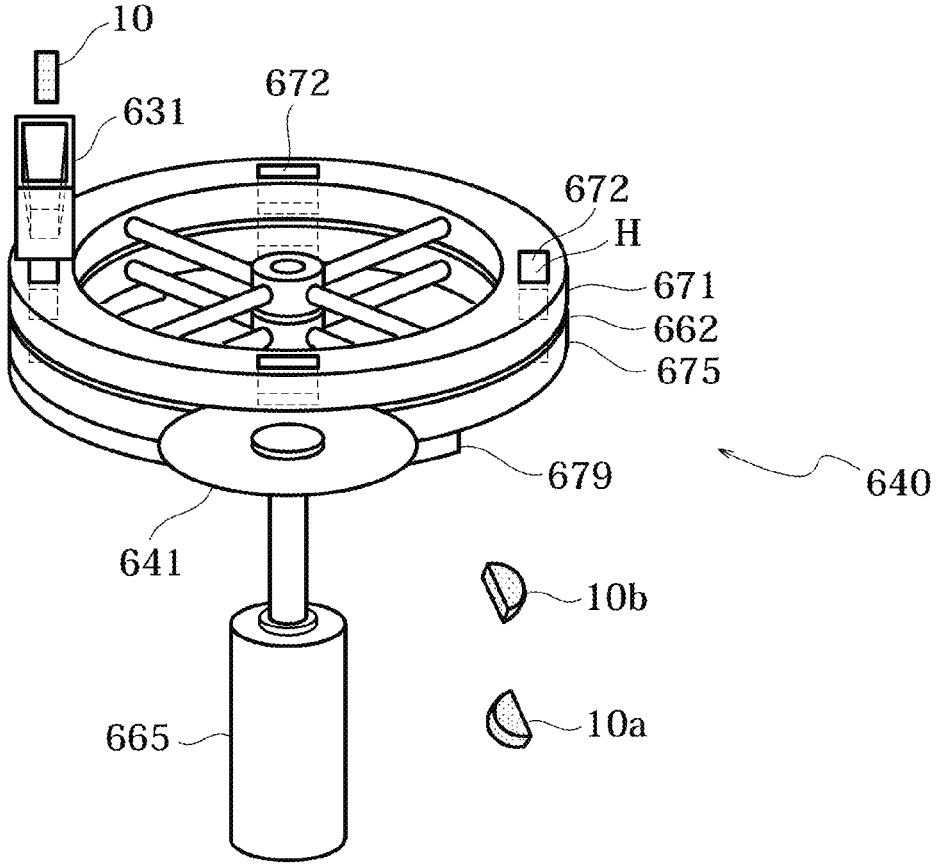

A specific configuration of a tablet splitting apparatus according to a thirteenth embodiment of the present invention will be described with reference to the drawings. FIG. 26*a* is a developed view of a cutting mechanism 640, and FIG. 26*b* is a perspective view of the cutting mechanism 640.

The tablet splitting apparatus differs from the embodiments in FIGS. 24 and 25 discussed above in that the cutting mechanism 640 cuts horizontally rather than vertically.

The cutting mechanism 640 uses a combination of two split rotatable members 671 and 675 in place of the integral rotatable member 461 in FIG. 24. In order to support the change from vertical cutting to horizontal cutting, the split rotatable members 671 and 675 and the rotary blade 641 are installed in such a posture that their rotational axes extend along a plumb line.

The split rotatable member 671 is mainly formed from a wheel-like ring portion, for example. One or more through holes 671 are formed in the ring portion. The number of the through holes 672 may be single or plural. The through holes 672 each vertically penetrate through the ring portion. The through holes 672 have a substantially rectangular opening and a substantially rectangular transverse cross section. The depth of the through holes 672 is close to half the diameter of the tablet 10. The short sides of the through holes 671 are slightly longer than the thickness of the tablet 10. The long sides of the through holes 671 are slightly longer than the diameter of the tablet 10. The split rotatable member 671 can be attached to a rotary shaft of an electric motor (not shown) via suitable rods 673 and a hub 674.

As with the split rotatable member 671, the split rotatable member 675 is also mainly formed from a wheel-like ring portion, for example, and through holes 676 are formed in the ring portion. The number and the arrangement of the through holes 676 are the same as those of the through holes 672. The through holes 676 each vertically penetrate through the ring portion. The through holes 676 have a substantially rectangular opening and a substantially rectangular transverse cross section. The depth of the through holes 676 is close to half the diameter of the tablet 10. The short sides of the through holes 676 are slightly longer than the thickness of the tablet 10. The long sides of the through holes 676 are slightly longer than the diameter of the tablet 10. The split rotatable member 675 can also be attached to a rotary shaft of an electric motor (not shown) via rods 677 and a hub 678.

The split rotatable member 675 is installed immediately below the split rotatable member 671. The gap between the split rotatable members 671 and 675 forms an annular groove 662 configured to allow insertion of the rotary blade 641.

The through holes 671 and the through holes 676 are formed to be continuous with each other in one-to-one correspondence. Each pair of the through holes 671 and 676 form a hole H capable of receiving the tablet 10 dropped from the falling tablet guiding member 631. The holes H each communicate with the groove 662.

Further, a semi-circular fixing plate 679 is disposed as a tablet transfer mechanism in addition to the split rotatable members 671 and 675 discussed above. With the fixing plate 679 provided immediately below the split rotatable member 675, the bottom of the through hole 676 is blocked over a portion of a tablet transfer path extending from the tablet receiving position below the falling tablet guiding member 631 to the tablet cutting position at the rotary blade 641 and opened at a location in the tablet transfer path past the rotary blade 641.

In this case, when the tablet 10 discharged from the tablet cassette 621 is guided to the split rotatable member 671 by the falling tablet guiding member 631 any of the holes H formed in the split rotatable members 671 and 675 has come to a location immediately below the falling tablet guiding member 631 and the tablet 10 is received in the hole H in the vertical posture. At this position, the bottom of the hole H is blocked by the fixing plate 679, and play for the tablet 10 in the hole H is marginal. Thus, also in this case, the tablet 10 is stably held in the hole H.

Thereafter, the split rotatable members 671 and 675 are rotated to feed the tablet 10 to the rotary blade 641 together with the hole H. The tablet 10 is split into two equal upper and lower halves by the rotary blade 641 inserted into and rotating in the groove 662 to obtain two half tablets 10*a* and 10*b*. When the split rotatable members 671 and 675 are further rotated and the hole H is disengaged from the fixing plate 679, the bottom of the hole H is opened, and the half tablets 10*a* and 10*b* fall down. In this way, also in this case, the tablet 10 is fed to the rotary blade 641 by a simple and adjustment-free tablet transfer mechanism to be split into the half tablets 10*a* and 10*b* by the rotary blade 641.

The invention claimed is:

1. A tablet splitting apparatus comprising:

a holding mechanism capable of holding a tablet to be split at a cutting position;

a cutting mechanism capable of cutting the tablet held at the cutting position;

a falling tablet guiding member including a groove-shaped tablet falling path operable to guide the tablet falling by gravity and having an upper-end opening portion, a lower-end opening portion, and a side-surface opening portion located between the upper-end opening portion and the lower-end opening portion, wherein the cutting position is located in a middle of the tablet falling path;

a groove depth regulating member capable of covering a part of or the entire side-surface opening portion of the tablet falling path, the side-surface opening portion including a portion of the tablet falling path upstream of the cutting position;

a path thickness adjusting mechanism capable of changing a relative distance between a groove bottom of the tablet falling path opposite to the side-surface opening portion and a groove bottom facing surface of the groove depth regulating member; and a control device including cutting operation regulating section for regulating operating steps of the cutting mechanism and the holding mechanism, wherein:

the cutting mechanism includes a pair of opposed blades each displaceable between a movement stand-by position and a movement completion position, and is configured to cut the tablet located at the cutting position by displacing both of the opposed blades in the pair from the movement stand-by position to the movement completion position;

the cutting operation regulating section regulates the operating steps such that when both of the opposed blades in the pair are displaced from the movement stand-by position to the movement completion position, the holding mechanism continuously holds the tablet until the tablet is caught between the pair of opposed blades, and after the tablet has been caught between the pair of opposed blades, the holding mechanism releases the tablet and only the pair of opposed blades hold the tablet to cut into the tablet; and the control device acquires thickness information on a thickness of the tablet to actuate the path thickness adjusting mechanism to adapt the relative distance to the thickness of the tablet.

2. A tablet splitting apparatus comprising:

a holding mechanism capable of holding a tablet to be split at a cutting position;

a cutting mechanism capable of cutting the tablet held at the cutting position; and cutting operation regulating section for regulating operating steps of the cutting mechanism and the holding mechanism, wherein:

the cutting mechanism includes a pair of opposed blades each displaceable between a movement stand-by position and a movement completion position, and is configured to cut the tablet located at the cutting position by displacing both of the opposed blades in the pair from the movement stand-by position to the movement completion position; and the cutting operation regulating section regulates the operating steps such that when both of the opposed blades in the pair are displaced from the movement stand-by position to the movement completion position, the holding mechanism continuously holds the tablet until the tablet is caught between the pair of opposed blades, and after the tablet has been caught between the pair of opposed blades, the holding mechanism releases the tablet and only the pair of opposed blades hold the tablet to cut into the tablet after the holding mechanism releases the tablet.

3. The tablet splitting apparatus according to claim 1, wherein:

the cutting operation regulating section regulates the operating steps such that when the holding mechanism releases the tablet, displacement of the pair of opposed blades is temporarily stopped until the holding mechanism completely releases the tablet.

4. The tablet splitting apparatus according to claim 2, wherein the cutting operation regulating section regulates the operating steps such that when the holding mechanism releases the tablet, one or both of an operation in which the holding mechanism is moved away from the tablet caught between the pair of opposed blades and an operation in which the tablet is moved away from the holding mechanism by moving the pair of opposed blades catching the tablet in a direction away from the holding mechanism.

5. The tablet splitting apparatus according to claim 2, further comprising:

a falling tablet guiding member including a groove-shaped tablet falling path operable to guide the tablet falling by gravity and having an upper-end opening portion, a lower-end opening portion, and a side-surface opening portion located between the upper-end opening portion and the lower-end opening portion, wherein the cutting position is located in a middle of the tablet falling path;

a groove depth regulating member capable of covering a part of or the entire side-surface opening portion of the tablet falling path, the side-surface opening portion including a portion of the tablet falling path upstream of the cutting position;

a path thickness adjusting mechanism capable of changing a relative distance between a groove bottom of the tablet falling path opposite to the side-surface opening portion and a groove bottom facing surface of the groove depth regulating member; and a control device capable of acquiring thickness information on a thickness of the tablet to actuate the path thickness adjusting mechanism to adapt the relative distance to the thickness of the tablet.

6. The tablet splitting apparatus according to claim 1, wherein:

the holding mechanism includes a receiving member disposed in the tablet falling path to partially block the tablet falling path to temporarily hold the tablet to be split, which has fallen down along the tablet falling path, at the cutting position; and the control device controls the receiving member and the cutting mechanism such that operations of the receiving member and the cutting mechanism are associated with each other.

7. The tablet splitting apparatus according to claim 1, further comprising:

a groove width adjusting mechanism provided in a portion of the tablet falling path upstream of the cutting position to adjust a groove width of the tablet falling path, wherein:

the control device acquires width information on a width of the tablet to actuate the groove width adjusting mechanism to adapt the groove width to the width of the tablet.

8. The tablet splitting apparatus according to claim 1, wherein:

the cutting mechanism is configured to space the tablet from the groove bottom of the tablet falling path opposite to the side-surface opening portion in a process in which the pair of opposed blades are displaced from the movement stand-by position to the movement completion position, and to accomplish cutting of the tablet thereafter.

9. The tablet splitting apparatus according to claim 8, wherein:

the pair of opposed blades are disposed such that one of the pair of opposed blade is displaced through the groove bottom and the other is displaced through the groove depth regulating member.

10. The tablet splitting apparatus according to claim 9, wherein:

the cutting mechanism is configured such that one or both of the pair of opposed blades are retracted within a movable range when the one or both of the pair of opposed blades are pushed toward the movement stand-by position by an external force, and the one or both of the pair of opposed blades are biased to be advanced by a force stronger than the weight of the tablet during such retraction from the start of or in the middle of the retraction.

11. The tablet splitting apparatus according to claim 10, wherein a portion of the tablet falling path upstream of the cutting position is meandering.

12. The tablet splitting apparatus according to claim 5, wherein:

the tablet falling path is branched at or downstream of the cutting position to form a portion of the tablet falling path downstream of a branch point into two branch paths;

the receiving member includes two path opening - closing members; and the two path opening - closing members are provided in the vicinity of the branch point between the two branch paths to open and close the corresponding branch paths, and are separately disposed on both sides of the cutting position.

13. The tablet splitting apparatus according to claim 7, wherein:

the control device is configured to choose whether the split tablet pieces obtained by splitting the tablet are caused to fall into the same branch path or different branch paths by switching the temporal order of a time at which the pair of opposed blades of the cutting mechanism are retracted from the movement completion position to the movement stand-by position after the tablet has been cut and a time at which the two path opening-closing members open the corresponding branch paths.

14. The tablet splitting apparatus according to claim 2, wherein:

the cutting mechanism includes a pair of opposed blades each displaceable between a movement stand-by position and a movement completion position, the pair of opposed blades each being a straight blade; and the cutting mechanism is configured to cut the tablet located at the cutting position by displacing the pair of opposed blades from the movement stand-by position to the movement completion position by relatively moving the pair of opposed blades in opposite directions while keeping the pair of opposed blades in parallel with each other.

15. The tablet splitting apparatus according to claim 14, wherein the cutting mechanism includes a four-bar parallel link, and the pair of opposed blades are provided on two opposite sides of the four-bar parallel link.

16. The tablet splitting apparatus according to claim 14, wherein:

the holding mechanism includes a receiving member capable of temporarily holding the tablet to be split at the cutting position;

the tablet splitting apparatus further comprises:

tablet position adjusting section for adjusting the cutting position of the tablet with respect to the pair of opposed blades by moving the receiving member, and information acquiring section for acquiring medicine information on the tablet; and the control device actuates the tablet position adjusting section based on the medicine information acquired by the information acquiring section, and further controls the receiving member and the cutting mechanism such that operations of the receiving member and the cutting mechanism are associated with each other.

17. The tablet splitting apparatus according to claim 1, wherein:

the cutting mechanism includes a rotary blade;

the holding mechanism includes a tablet transfer mechanism capable of feeding the held tablet to the cutting position;

the tablet transfer mechanism includes a rotatable member capable of rotating about a rotary shaft and a driving member capable of driving the rotatable member, the rotatable member including a plurality of tablet receiving portions provided in an outer peripheral portion centered about the rotary shaft and disposed at equal intervals in a circumferential direction to receive the tablet, the rotatable member also having an annular groove formed in the outer peripheral portion to continuously extend in the circumferential direction, the groove communicating with the plurality of tablet receiving portions and allowing the rotary blade to partially enter thereinto to cut the tablet held in the tablet receiving portion; and the tablet transfer mechanism is configured such that the tablet is put into the tablet receiving portion when the tablet receiving portion comes to a tablet feed position, and the tablet which has been split is discharged from the tablet receiving portion when the tablet receiving portion comes to a tablet discharge position.

18. The tablet splitting apparatus according to claim 2, wherein:

the cutting operation regulating section regulates the operating steps such that when the holding mechanism releases the tablet, displacement of the pair of opposed blades is temporarily stopped until the holding mechanism completely releases the tablet.

19. The tablet splitting apparatus according to claim 3, wherein the cutting operation regulating section regulates the operating steps such that when the holding mechanism releases the tablet, one or both of an operation in which the holding mechanism is moved away from the tablet caught between the pair of opposed blades and an operation in which the tablet is moved away from the holding mechanism by moving the pair of opposed blades catching the tablet in a direction away from the holding mechanism.

* * * * *